US011840100B2

(12) United States Patent
Kagami et al.

(10) Patent No.: US 11,840,100 B2
(45) Date of Patent: Dec. 12, 2023

(54) RECORDING APPARATUS

(71) Applicant: CANON KABUSHIKI KAISHA, Tokyo (JP)

(72) Inventors: Yuji Kagami, Kanagawa (JP); Gakushi Tanaka, Kanagawa (JP); Toru Yada, Kanagawa (JP); Yasuhito Tsubakimoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 72 days.

(21) Appl. No.: 17/670,109

(22) Filed: Feb. 11, 2022

(65) Prior Publication Data

US 2022/0258504 A1 Aug. 18, 2022

(30) Foreign Application Priority Data

Feb. 17, 2021 (JP) ..... 2021-023532

(51) Int. Cl.
*B41J 29/13* (2006.01)

(52) U.S. Cl.
CPC ..... *B41J 29/13* (2013.01)

(58) Field of Classification Search
CPC ..... B41J 29/13; B41J 29/02
See application file for complete search history.

(56) References Cited

U.S. PATENT DOCUMENTS 5,863,141 A * 1/1999 Hong ..... B41J 29/02 361/759
10,958,806 B2 3/2021 Ishihara et al.
11,006,010 B2 5/2021 Ota et al.
11,124,004 B2 9/2021 Umehara et al.
2012/0099163 A1* 4/2012 Ito ..... H04N 1/00519 358/474
2014/0255057 A1* 9/2014 Yoshino ..... G03G 21/206 399/92

FOREIGN PATENT DOCUMENTS

JP 2008-015052 1/2008
JP 2008-260154 10/2008

OTHER PUBLICATIONS

Kudo, Shoshin, Liquid Supply Unit and Liquid Injection Device, Oct. 24, 2019, Japan, All Pages (Year: 2019).*

* cited by examiner

*Primary Examiner* — Justin Seo
*Assistant Examiner* — Tracey M McMillion
(74) *Attorney, Agent, or Firm* — Venable LLP

(57) ABSTRACT

A recording apparatus, including: a recording portion; a case in which the recording portion is accommodated; and a cover which has a holding portion to be grasped at a time of carrying the recording apparatus at a position adjacent to the case, in which the case has a boundary wall surface extending in a direction intersecting with a bottom surface of the recording apparatus toward an inside of the casing, in which the cover has a contact portion that abuts against the boundary wall surface of the case in a vicinity of the holding portion, and in which the contact portion and the boundary wall surface are arranged in line in a direction that intersects with a direction of formation of the side wall, and the contact portion and the boundary wall surface abut against each other to separate between an inside and an outside of the casing.

9 Claims, 28 Drawing Sheets

RECORDING APPARATUS

BACKGROUND OF THE INVENTION

Field of the Invention

The present invention relates to a recording apparatus such as a printer, a copying machine, or a facsimile, and more particularly, to a recording apparatus that forms an image by ejecting droplets.

Description of the Related Art

A so-called inkjet recording apparatus ejects, from a recording head, minute ink droplets, so-called mist, that do not contribute to recording of an image in addition to ink droplets serving as droplets that contribute to recording of an image. The size and mass of mist are small, which causes mist to float in the air inside the recording apparatus. Thus, air currents caused by scanning of a carriage contain mist. Air currents containing the mist flow out of a gap between exterior parts into the outside, and the mist adheres to and accumulates in a portion that is touched by a hand of an operator such as the outside of the recording apparatus, or a work surface or the like near the apparatus, so that the operator is stained with ink in some cases.

As in the case of Japanese Patent Application Publication No. 2008-015052, an apparatus that adopts a layout in which a holding portion to be held by an operator to lift up the apparatus is adjacent to an image forming unit sometimes causes mist to flow out of a gap of the holding portion during printing and pollute the nearby area of the holding portion. Therefore, in recent years, in order to remove an influence on an environment or a human body, there has been a demand for retaining all the mist inside the main body of the recording apparatus or collecting the mist without discharging the mist into the outside of the recording apparatus.

As a design method that prevents mist from leaking into the outside of the apparatus, Japanese Patent Application Publication No. 2008-260154 proposes the configuration of installing a fan for causing air currents near a recording portion such as a recording head, a carriage, or a platen inside the recording apparatus. The configuration controls air currents depending on the position or movement direction of the carriage to collect mist efficiently, but such a configuration requires a space for installing a fan or the like for collecting mist, leading to increase in size of the apparatus. Furthermore, installation of a fan increases the cost.

SUMMARY OF THE INVENTION

An object of the present invention is to provide a technology capable of preventing leakage of mist from the inside of the main body of a recording apparatus with a simple configuration.

In order to solve the above-mentioned problem, a recording apparatus according to the present invention includes:

- a recording portion that records an image on a recording material by ejecting liquid to the recording material;
- a case that forms a bottom of a casing in which the recording portion is accommodated; and
- a cover that forms a side wall of the casing, which has a holding portion to be grasped at a time of carrying the recording apparatus at a position adjacent to the case,
- wherein the case has a boundary wall surface extending in a direction intersecting with a bottom surface of the recording apparatus toward an inside of the casing,

- wherein the cover has a contact portion that abuts against the boundary wall surface of the case in a vicinity of the holding portion, and
- wherein the contact portion and the boundary wall surface are arranged in line in a direction that intersects with a direction in which the side wall is formed, and the contact portion and the boundary wall surface abut against each other to separate between an inside and an outside of the casing.

According to the present invention, it is possible to prevent leakage of mist from the inside of the main body of a recording apparatus with a simple configuration.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

A recording apparatus 1 according to a first embodiment of the present invention is an example of applying the present invention to a so-called inkjet printer, which records an image by ejecting ink serving as liquid for recording an image to a recording material (liquid ejection system). The recording apparatus to which the present invention can be applied includes a recording apparatus such as a printer used as an output device such as a multi-function electronic device or a workstation including, for example, a printer, a copying machine, a facsimile, and a computer. That is, the recording apparatus to which the present invention can be applied is a recording apparatus that records an image on a recording medium such as a recording sheet based on image information transferred by a control signal. The word "recording" herein is not limited to the case of forming information with meaning such as a character or a shape, but also includes the case of forming, for example, an image, a pattern, a design, or a pattern on a recording medium in a broad sense irrespective of whether the information contains meaning or not, or the case of processing a medium, which is not necessarily exhibited so as to enable visual recognition by a person. Furthermore, in this example, it is assumed that the word "recording medium" (recording material) means a sheet material (sheet), but may also mean, for example, cloth and a plastic film.

Typical examples of utilizing the present invention include a recording apparatus such as a printer or a facsimile, which uses an inkjet system, especially, a recording apparatus that is carried or moved by lifting up the holding portion of the recording apparatus.

Figure 1:
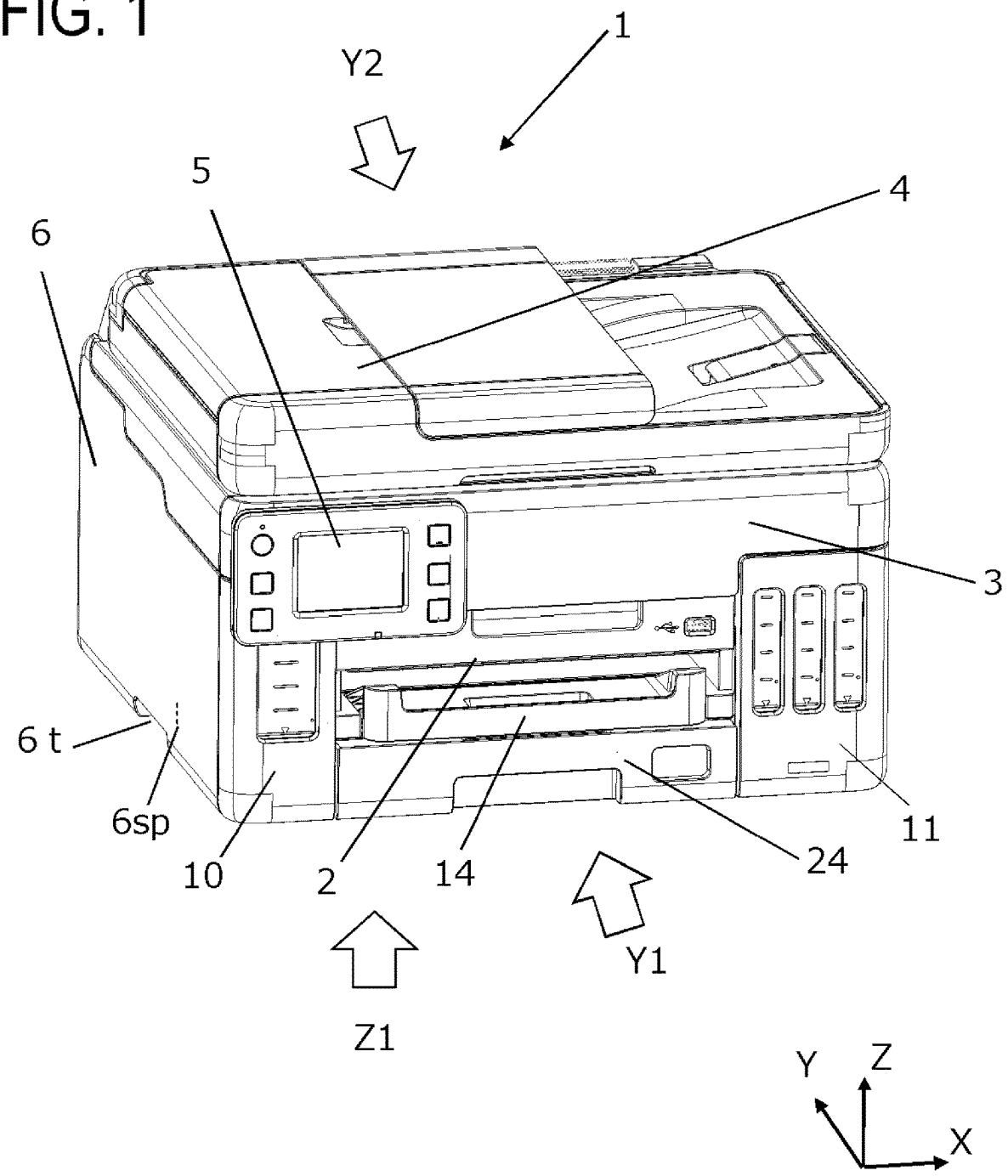
FIG. 1 is an external oblique view of a recording apparatus according to a first embodiment.

Referring to FIG. 1, a recording apparatus (multi-function peripheral) that integrates a printer, a document reader (scanner), and an automatic document feeder (ADF) is described as the first embodiment of the present invention. However, the present invention is not limited thereto, and the recording apparatus may not include a scanner or an ADF. FIG. 1 is an external oblique view of a recording apparatus according to the first embodiment. The recording apparatus 1 mainly includes a main body 2 (details thereof are described later), a scanner 3, an ADF 4, an operation panel 5, an automatic sheet feeder (ASF) 13 (refer to FIG. 7), and a controller (control circuit board provided inside the main body), which is not shown. The main body 2 includes a sheet discharge tray 14 (pulled out in front to be used) that accumulates and holds recording sheets printed by a recording portion 12 (refer to FIG. 7), and a cassette unit 24 that causes the recording portion 12 to convey recording sheets automatically when an operator fills the cassette unit 24 with recording sheets and mounts the cassette unit 24 to the main body 2.

The main body 2 is a general term for a component of the recording apparatus 1, which mainly performs a printing operation, excluding the scanner 3, the ADF 4, and the operation panel 5.

The arrows X, Y, Z in FIG. 1 indicate a width direction, a depth direction, and a height direction of the recording apparatus 1, respectively, and those directions intersect with one another (orthogonal to one another). Regarding each direction, as indicated by the arrows of FIG. 1, the X direction is represented by left or right, the Y direction is represented by front/front surface/front end or back/back surface/back end, and the Z direction is represented by upper or lower, for example. The same holds true for the arrows X, Y, Z of other diagrams. Each direction described above is defined with respect to the surface on which the recording apparatus 1 is installed. For example, when the recording apparatus 1 is installed on a horizontal surface, which is a usually expected installation state, the Z direction, which is the height direction, matches the vertical direction (gravity direction), and the X direction and the Y direction match the horizontal direction.

The operator faces the recording apparatus 1 in the direction of the arrow Y1 at the time of using the recording apparatus 1.

A left side cover 6, which forms the left side wall of the apparatus casing, is mounted to the left side surface of the main body 2. A holding portion 6*t* to be grasped (touched) by a hand when the user lifts up or moves the main body 2 at the time of carrying the apparatus is formed below the left side cover 6. Furthermore, a speaker pore sp described later is formed on the left side cover 6, which enables the operator to hear a notification sound such as an operation sound produced by a speaker 30 (refer to FIG. 21) provided in the main body 2.

Figure 2:
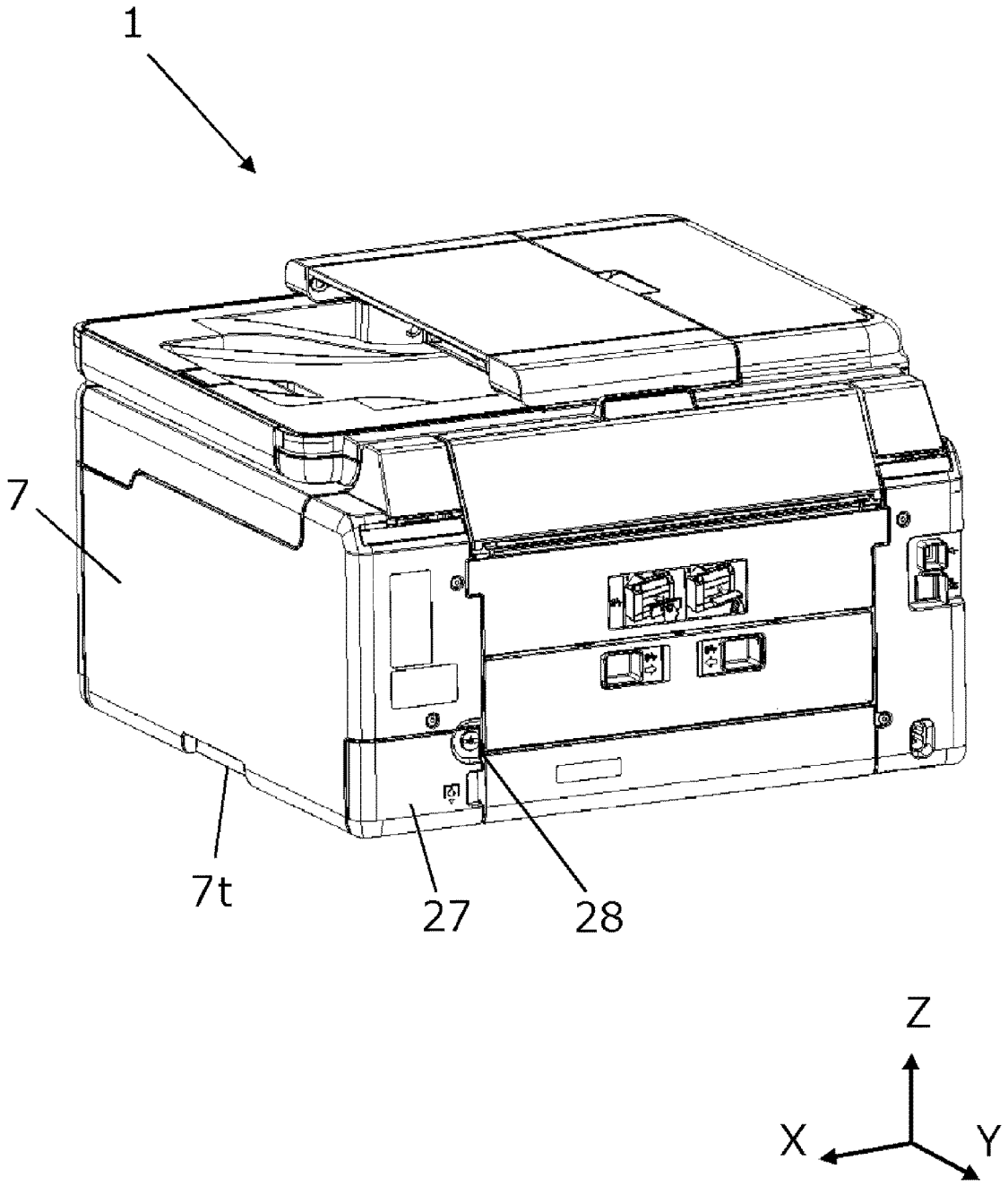
FIG. 2 is a rear oblique view of the recording apparatus according to the first embodiment.

FIG. 2 is a view taken along the arrow Y2 of FIG. 1, namely, a rear oblique view of the recording apparatus 1 according to this embodiment. A right side cover 7, which forms the right side wall of the apparatus casing, is mounted to the right side surface of the main body 2. A holding portion 7*t* to be grasped by a hand when the user lifts up or moves the main body 2 at the time of carrying the apparatus or the like is formed below the right side cover 7.

Figure 3A:
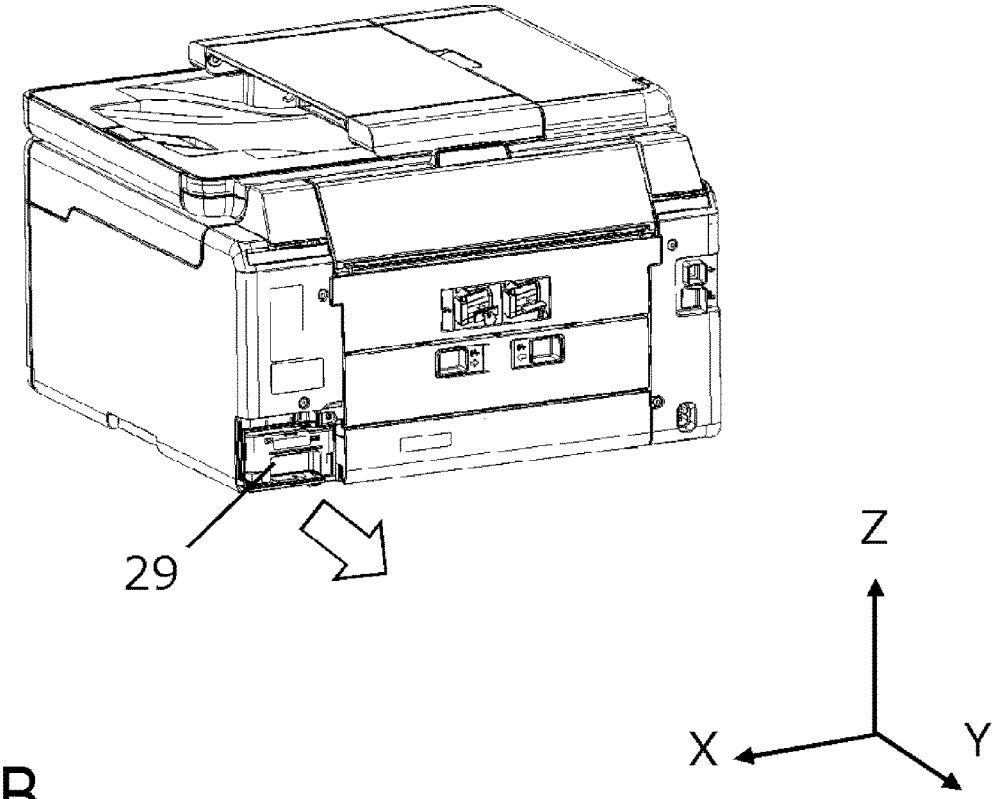
FIGS. 3A and 3B are rear oblique views of the recording apparatus according to the first embodiment.
Figure 3B:
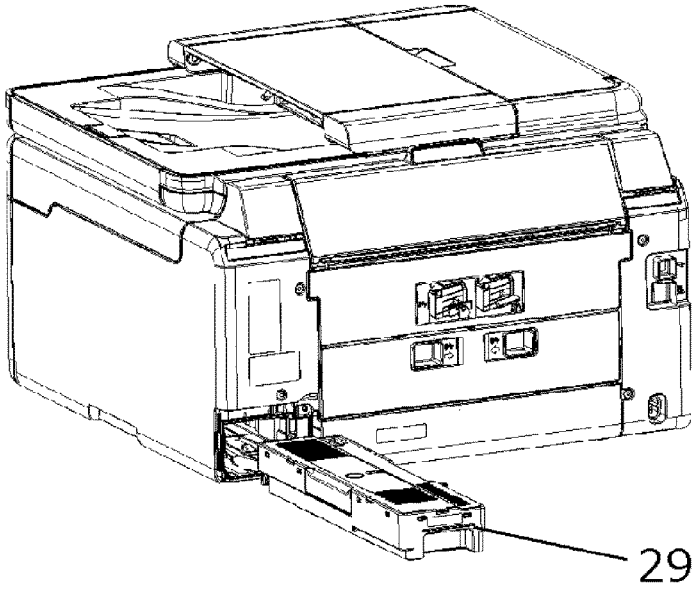

Similarly to FIG. 2, FIGS. 3A and 3B are views taken along the arrow Y2 of FIG. 1, namely, rear oblique views of the recording apparatus 1 according to this embodiment. FIGS. 3A and 3B illustrate a situation in which a maintenance cartridge 29 is removed. As illustrated in FIG. 2, a cover 27 for protecting the maintenance cartridge 29 is screwed to the main body 2 by a coin screw 28 on the back surface side of the recording apparatus 1. The maintenance cartridge 29 is a unit replaceable by the operator, which stores an absorbent 33 (refer to FIG. 24) holding ink liquid inside a casing constructed by an upper case and a lower case. The absorbent 33 is used to store ink liquid discharged by absorbing ink from the recording head 32 (refer to FIG.

6) or wiping off dirt of the recording head 32. As a result, it is possible to keep the best state of the recording head 32. The maintenance cartridge 29 is exposed when the coin screw 28 is loosened and the cover 27 is removed from the main body 2. When the amount of ink inside the maintenance cartridge 29 reaches a predetermined amount, the user can pull the maintenance cartridge 29 out of the main body 2, and replace the maintenance cartridge 29 with new one (refer to FIGS. 3A and 3B).

Figure 4:
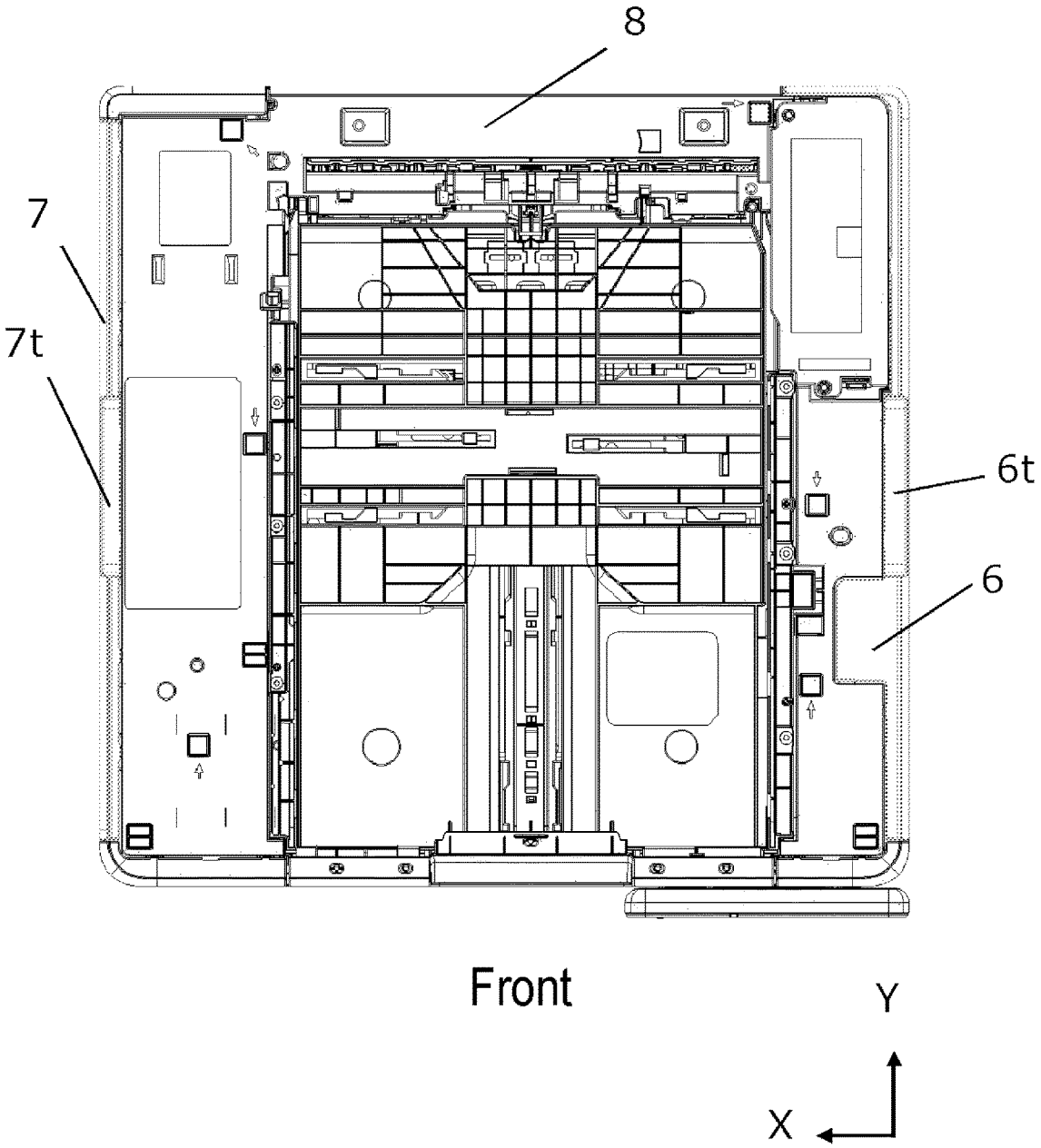
FIG. 4 is a view (bottom view) of the recording apparatus taken along the arrow Z1 of FIG. 1 according to the first embodiment.

FIG. 4 is a bottom view of the recording apparatus 1 according to this embodiment. As illustrated in FIG. 4, the holding portions 6*t* and 7*t* described above are provided at the positions of the center of gravity of the recording apparatus 1 in the depth direction, typically, substantially at the centers in the width direction of the lower end sides of the outer wall surfaces of the left and right side walls of the casing of the recording apparatus 1, so as to form a concave shape that is partially concave inward of the outer wall surface. Through this arrangement, it is possible to stably carry the recording apparatus 1 without tilting the recording apparatus 1, for example, when the operator or another person lifts up the recording apparatus 1 or moves the recording apparatus 1. The arrangement, number, combination, and the like of the holding portions 6*t* and 7*t* are not limited to the one-to-one configuration of providing a pair of left and right holding portions illustrated in this embodiment. Furthermore, a similar holding portion may also be provided on the front surface and back surface of the apparatus.

Figure 5:
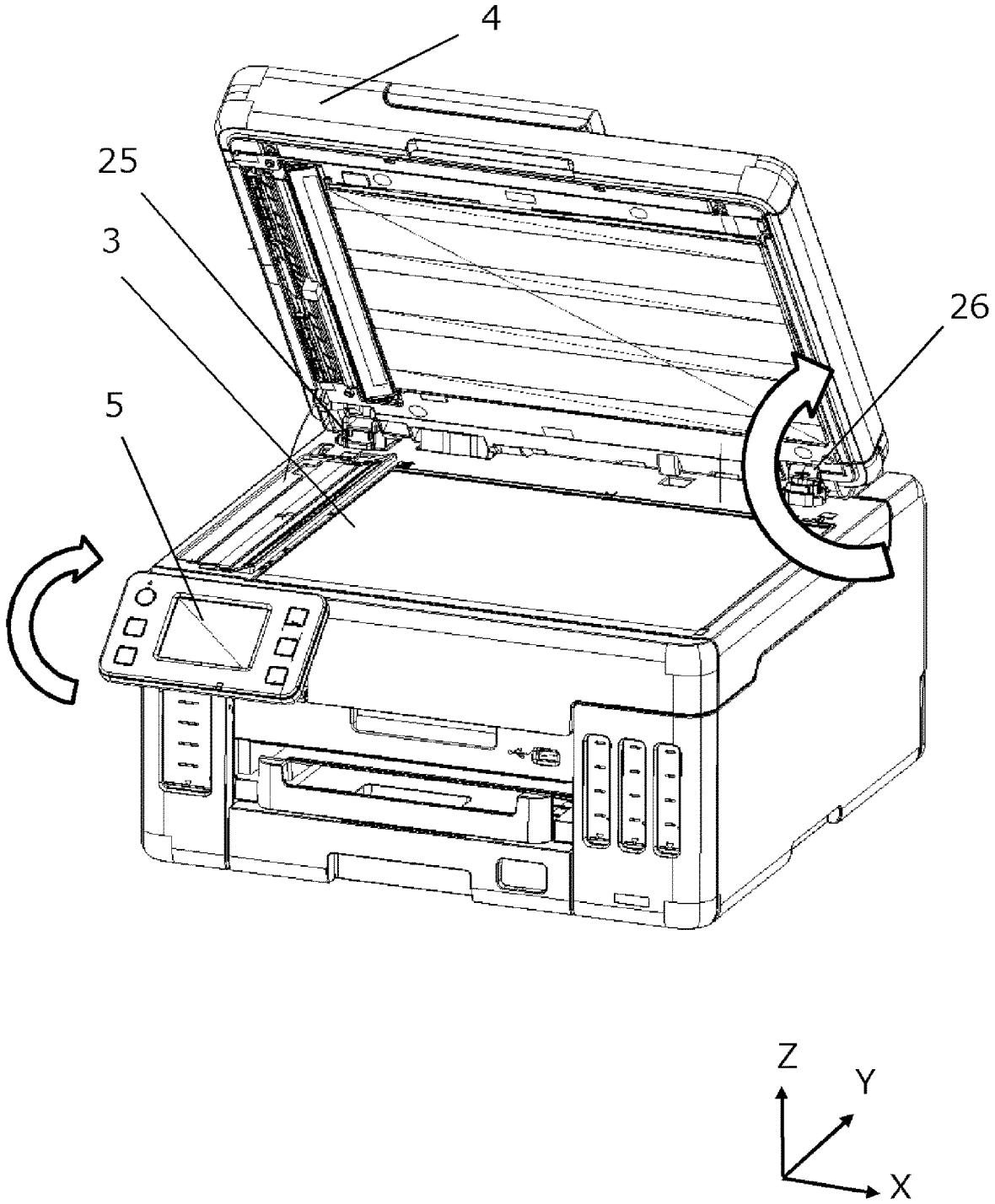
FIG. 5 is an external oblique view of the recording apparatus according to the first embodiment.

FIG. 5 is an oblique view of the recording apparatus 1 according to this embodiment at a time when the ADF 4 and the operation panel 5 have pivoted. As illustrated in FIG. 5, the operation panel 5 is mounted on the front left side of the scanner 3. The operation panel 5 is pivotally supported by the scanner 3 so that the operator can easily see a screen (display) or perform a key operation, and can be held at a position desired by the operator through a tilt mechanism (not shown). The ADF 4 is pivotally mounted to the scanner 3 by an ADF hinge mechanism 25 and an ADF hinge 26 mounted to the main body 2. The ADF hinge mechanism 25 causes a predetermined rotation torque, and thus the ADF 4 can be held at a predetermined angle. Therefore, when the operator causes the scanner 3 to read a document, the ADF 4 pivots in the arrow direction, and the document is set on the reading surface of the scanner 3. After the document is set, next, the ADF 4 is caused to pivot in a reverse direction to return to the original position, and a predetermined document reading operation is performed.

Figure 6:
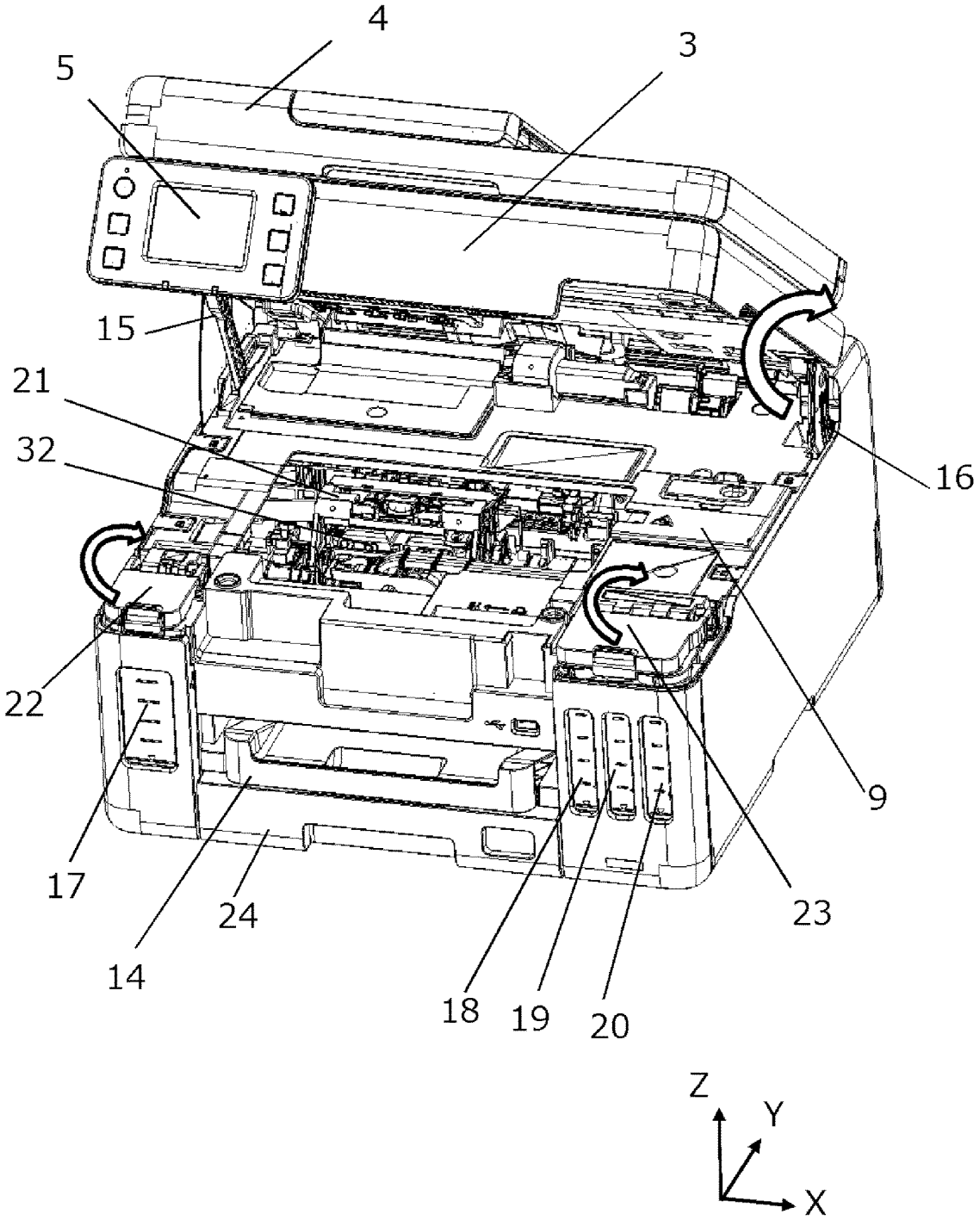
FIG. 6 is an external oblique view of the recording apparatus according to the first embodiment.

FIG. 6 is an oblique view at a time when the scanner 3 has opened (pivoted). When the scanner 3 has opened, the upper case 9 is exposed, and the operator can perform various kinds of operations described later. That is, a rotation shaft (not shown) provided in the back of the upper case 9 and a bearing portion (not shown) provided in the scanner 3 are mounted so as to engage with each other and enable the scanner 3 (including ADF 4 and operation panel 5) to pivot. When the scanner 3 pivots, a scanner support member 15 moves, and the scanner 3 can be held at a predetermined position (angle). A scanner damper mechanism 16 is a safety device for decreasing, when the operator closes the scanner 3, the closing speed of the scanner 3 and causing the scanner 3 to pivot slowly.

With the above-mentioned configuration, after the operator has performed a predetermined operation and caused the scanner 3 to pivot, a carriage 21 appears substantially at the center of the opening of the upper case 9, which enables replacement or the like of the recording head 32 removably mounted on a predetermined location of the carriage 21. Furthermore, when a tank cover 22 or a tank cover 23 is caused to pivot in the arrow direction, the inlets of ink tanks 17 to 20 are exposed. When there is a shortage of ink, the operator can refill the ink by pressing an ink bottle (not shown) against the inlet. Furthermore, for example, when a jam of a recording sheet has occurred for some reason, the operator can remove the recording sheet through the opening of the upper case 9.

The recording apparatus 1 according to this embodiment uses a method of printing by supplying ink from the ink tanks 17 to 20 to the recording head 32 via an ink tube (not shown), and applying the ink ejected from the recording head 32 to recording paper. When it is necessary to prevent ink leakage from the main body 2, such as when the recording apparatus 1 is carried, a choke unit (not shown) installed between the ink tanks 17 to 20 and the recording head 32 is operated. As a result, it is possible to block the inflow of ink from the ink tanks 17 to 20 to the recording head 32.

Figure 7:
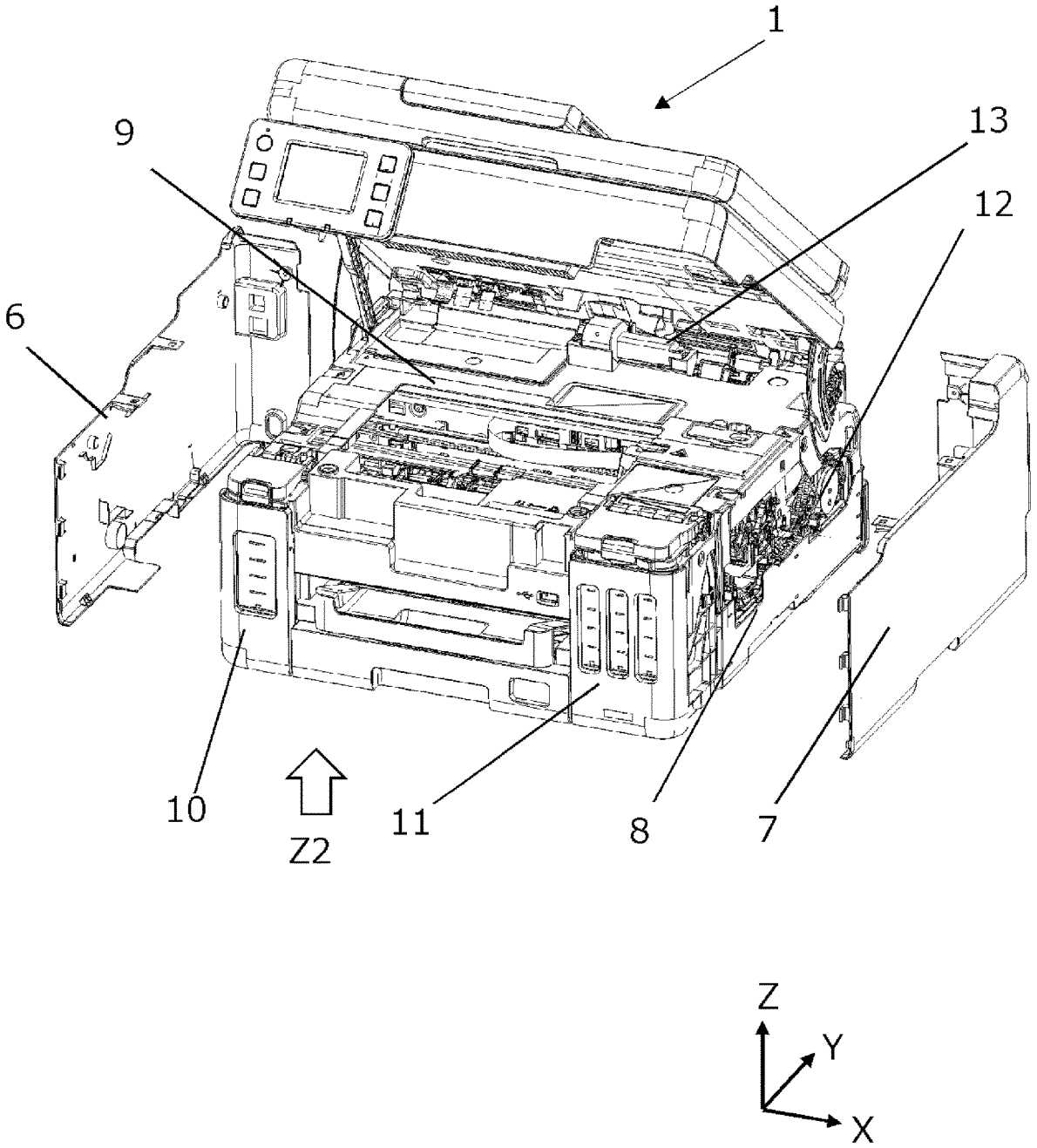
FIG. 7 is an external oblique exploded view of the recording apparatus according to the first embodiment.

FIG. 7 is an oblique view of the recording apparatus 1 in which the left side cover 6 and the right side cover 7 are removed from the main body 2 under a state in which the scanner unit 3 has pivoted. The structure of mounting the left side cover 6 and the right side cover 7 is described later.

Figure 8:
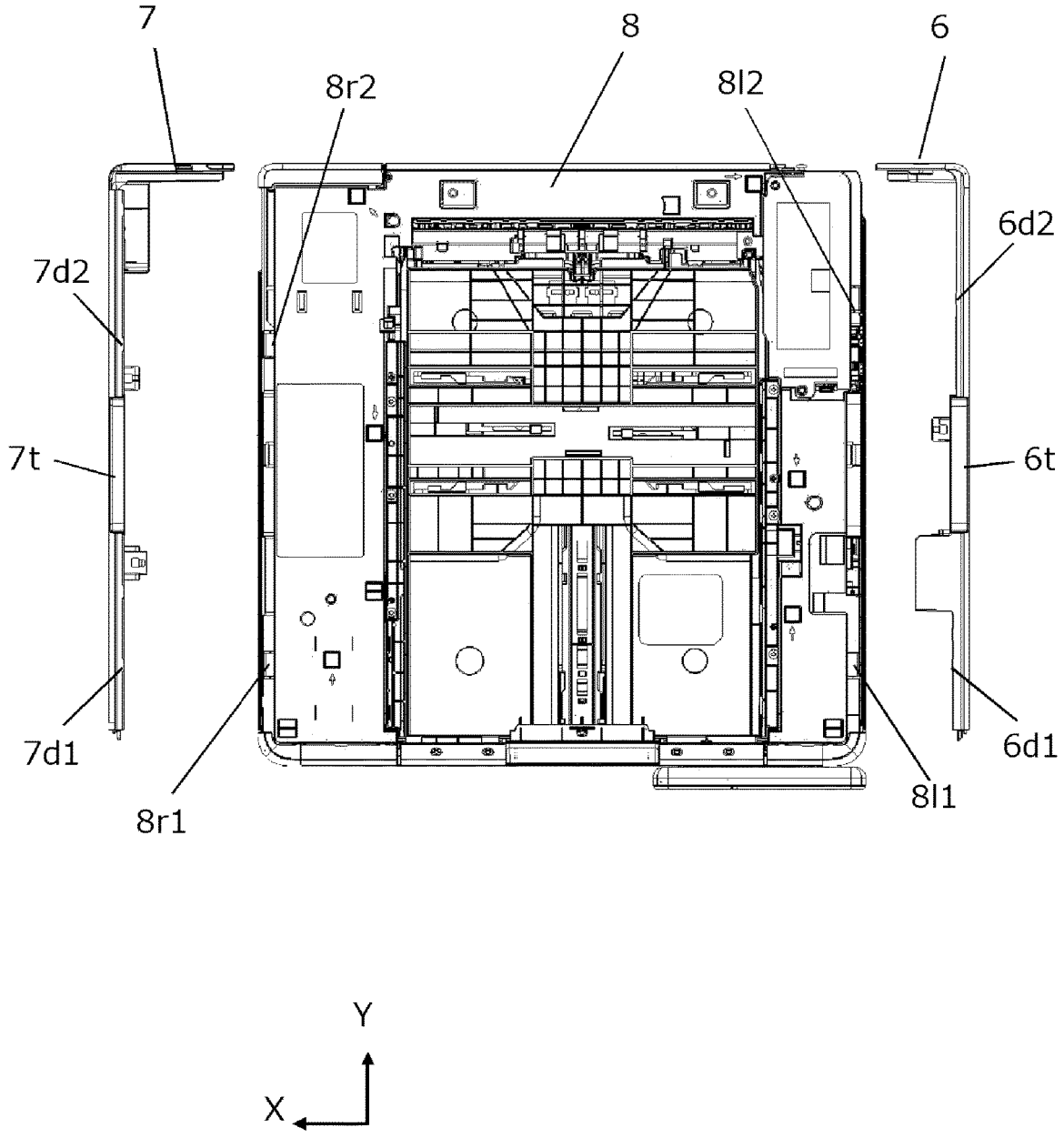
FIG. 8 is a view (bottom view) of the recording apparatus taken along the arrow Z2 of FIG. 7 according to the first embodiment.

FIG. 8 is a view taken along the arrow Z2 of FIG. 7, namely, a bottom view of the recording apparatus 1 according to this embodiment. The lower case 8 has a configuration of forming the bottom of the apparatus casing and supporting, from below, each component part of a recording portion or the like accommodated in the inside of the casing. The lower case 8 has grooves 8*l*1 and 8*l*2 for engaging hooks 6*d*1 and 6*d*2 provided in the left side cover 6 with the left lower end of the lower case 8 to which the left side cover 6 is mounted. The left side cover 6 is fixed to the left side of the lower case 8 by engaging the hooks 6*d*1 and 6*d*2 with the grooves 8*l*1 and 8*l*2. The lower case 8 further has grooves 8*r*1 and 8*r*2 for engaging hooks 7*d*1 and 7*d*2 provided in the right side cover 7 with the right lower end of the lower case 8 to which the right side cover 7 is mounted. The right side cover 7 is fixed to the right side of the lower case 8 by engaging the hooks 7*d*1 and 7*d*2 with the grooves 8*r*1 and 8*r*2.

Figure 9:
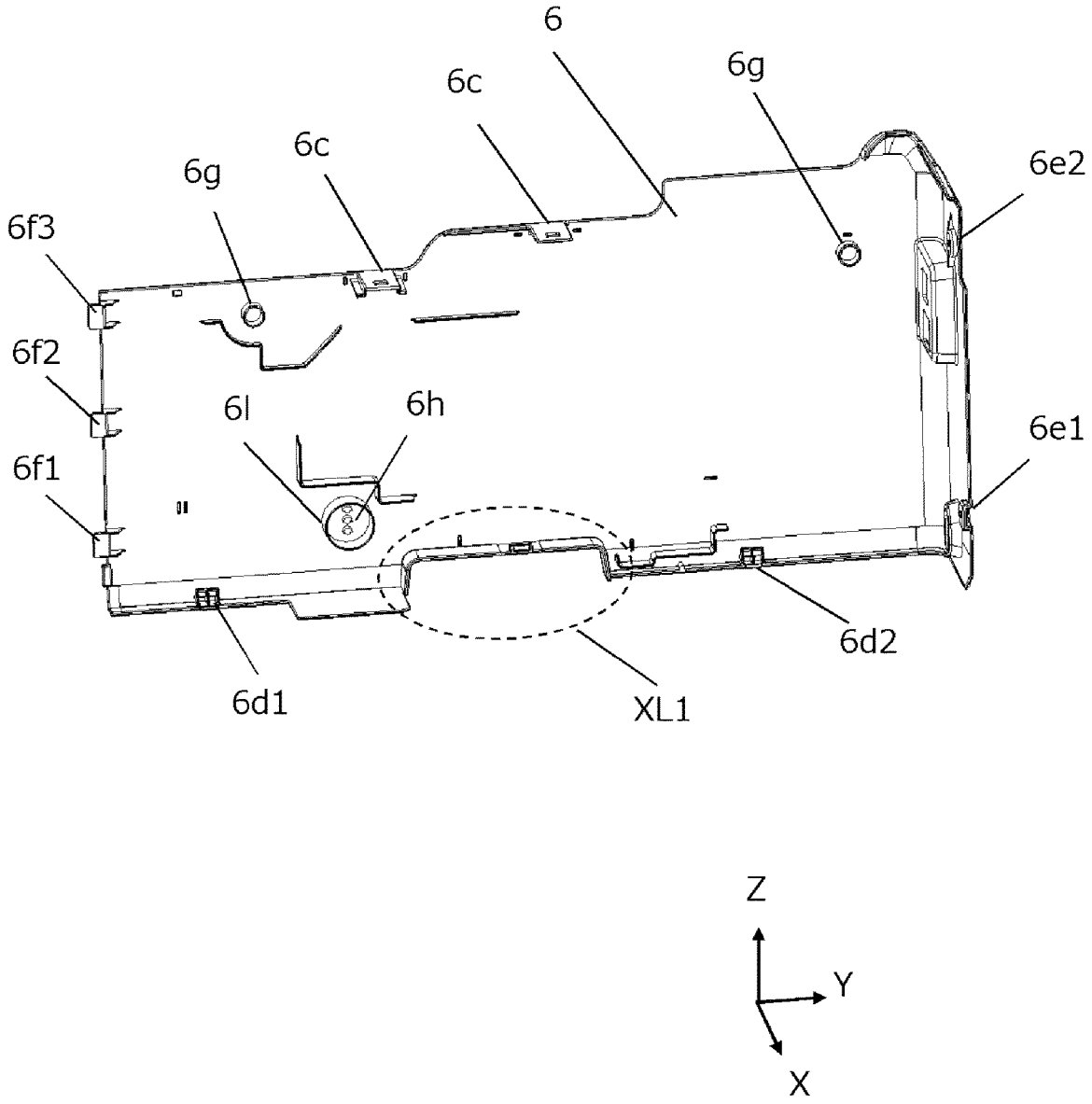
FIG. 9 is an oblique view of a left side cover in the first embodiment.

FIG. 9 is an oblique view of the left side cover 6 in the recording apparatus 1 according to this embodiment. Various kinds of shapes for engaging with the main body 2 and the left front cover 10 are formed on a side opposite to the exterior surface of the left side cover 6. That is, the hook 6*c* is used to engage the left side cover 6 with a predetermined location of the upper case 9. As described above, the hooks 6*d*1 and 6*d*2 engage with the grooves 8*l*1 and 8*l*2 formed in the lower case 8. A counterbore shape 6*e*1 is used to screw the left side cover 6 to the lower case 8. A counterbore shape 6*e*2 is used to screw the left side cover 6 to the upper case 9. Hooks 6*f*1 to 6*f*3 are used to engage the left side cover 6 with a front cover L. A boss 6*g* is used to position the left side cover 6 relative to the upper case 9. A rib 6*h* is used to prevent leakage of mist from a speaker pore 6*sp*. A rib 6*l* is used to collect a sound from the speaker 30.

Figure 10:
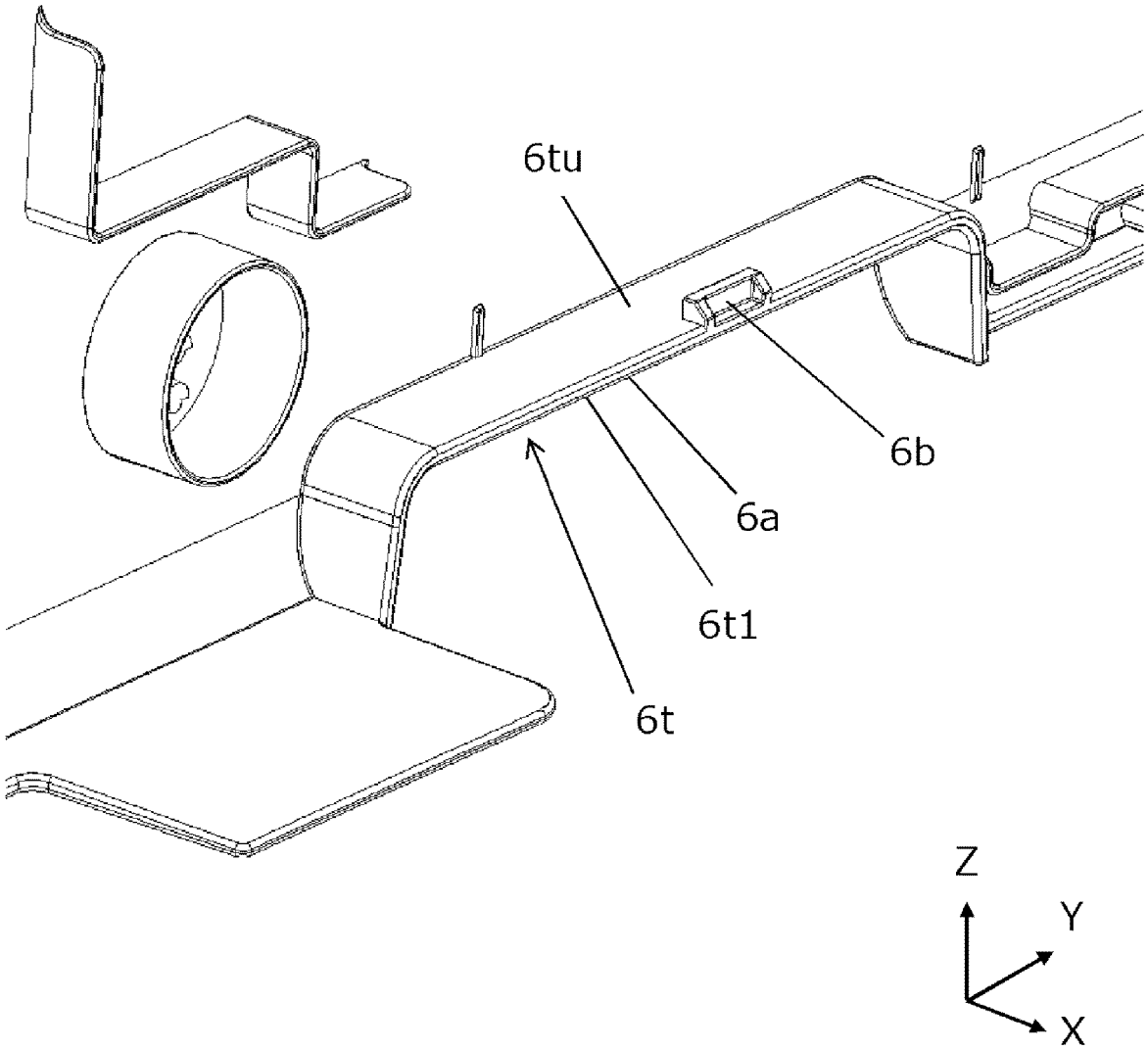
FIG. 10 is an enlarged oblique view (left side cover) of an XL1 portion in FIG. 9.

FIG. 10 is an enlarged oblique view of an XL1 portion in FIG. 9. That is, FIG. 10 is a specific view of the holding portion 6*t* in the left side cover 6. The holding portion 6*t* is provided at a position adjacent to a lower cover 8 at a lower end of the left side cover 6. The holding portion 6*t* is concave in an inverted U-shape upward from the lower end side of the left side cover 6, and has a shape that protrudes inward (X direction) from the back surface of the left side cover 6 to form a space at the lower end of the left side cover 6 that is concave from the outer wall surface of the left side cover 6 toward the inside of the apparatus. The concave space formed at the lower end of the left side cover 6 by the holding portion 6*t* is large enough for the operator or the like to insert his or her hand and grasp the holding portion 6*t*. The concave surface on the inner side of the holding portion 6*t* that forms such a space for grasping is a holding surface 6*t*1, and a convex outer side surface on the opposite side is an opposing surface 6*tu*, which is opposed to a constituent part serving as a boundary with the left side cover 6 in the lower case 8. In the vicinity of the holding portion 6*t*, a hook 6*b* is formed on the opposing surface 6*tu* of the holding portion 6*t*, and an abutment surface 6*a* (contact portion) is formed at the tip portion of the holding portion 6*t*. It is possible to separate between the inside and the outside of the casing of the recording apparatus 1 and prevent leakage of mist to the outside of the recording apparatus 1 by causing the abutment surface 6*a* to abut against a vertical wall 8*a*1 of the lower case 8 described later.

Figure 11:
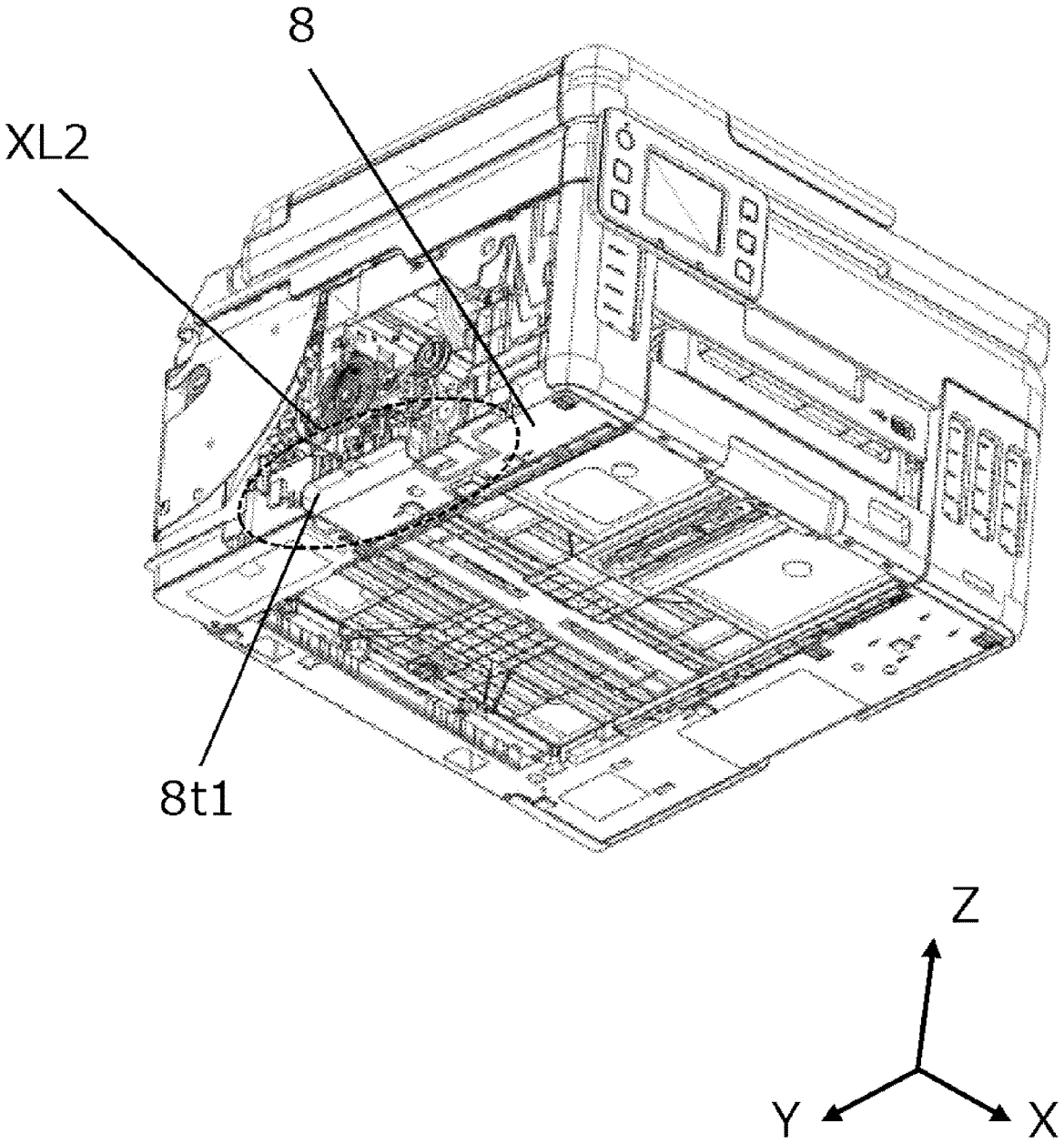
FIG. 11 is an oblique view of the left bottom of the recording apparatus according to the first embodiment.
Figure 12:
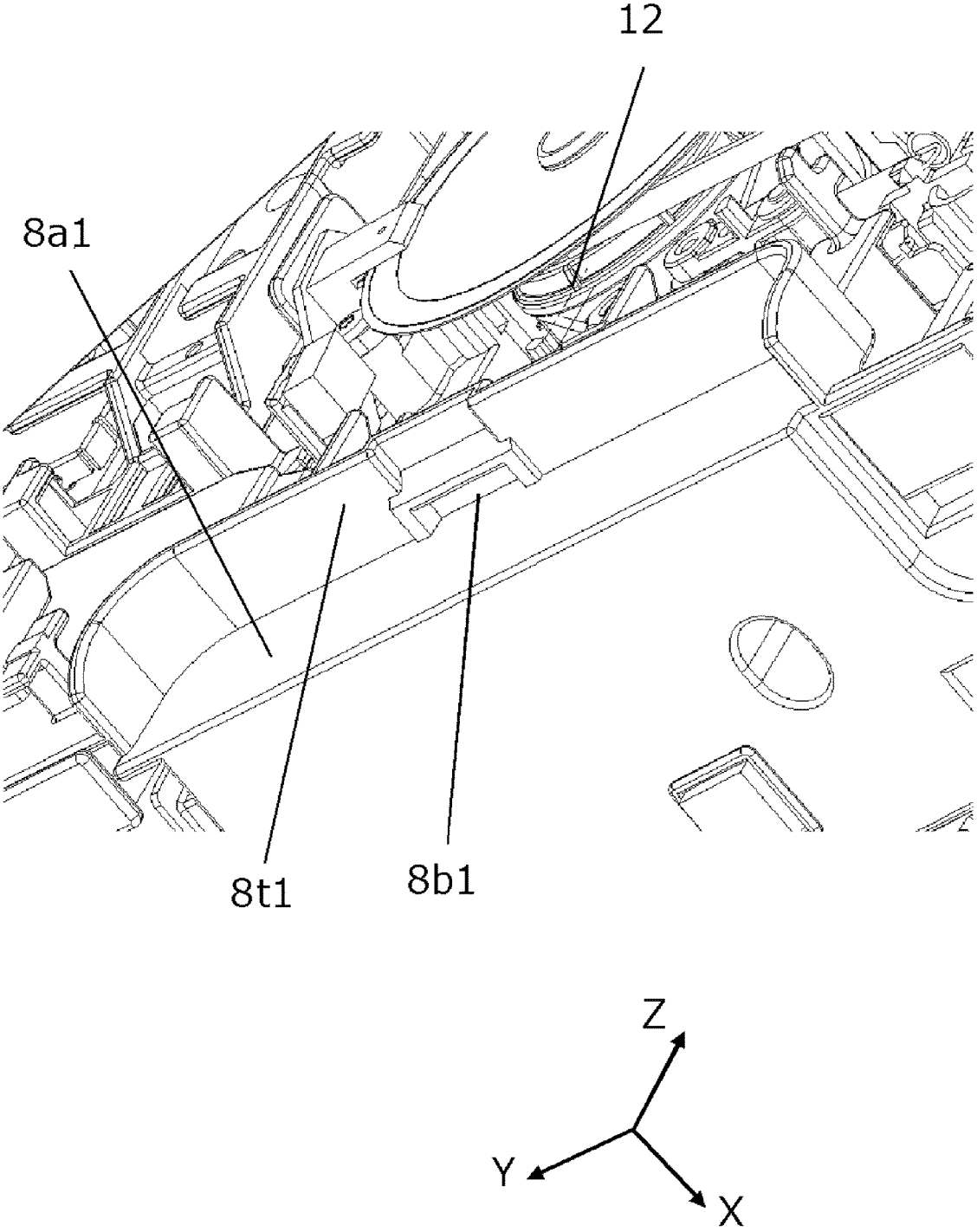
FIG. 12 is an enlarged oblique view of an XL2 portion in FIG. 11.

FIG. 11 is an oblique view of the bottom of the recording apparatus 1 according to this embodiment (oblique view of looking up at the recording apparatus 1 from below at an angle that enables visual recognition of the front surface, the left side surface, and the bottom). FIG. 12 is an enlarged specific view of an XL2 portion in FIG. 11. A horizontal portion 8*t*1 and the vertical wall 8*a*1 formed in the lower case 8 form a concave portion into which the holding portion 6*t* of the left side cover 6 is inserted. Furthermore, a groove 8*b*1 is formed on the lower surface of the horizontal portion 8*t*1. With the above-mentioned configuration, when the left side cover 6 is mounted to the main body 2, the hook 6*b* of the left side cover 6 engages with the groove 8*b*1 of the lower case 8. Furthermore, the abutment surface 6*a* of the left side cover 6 abuts against the vertical wall 8*a*1 formed in the lower case 8.

Figure 13:
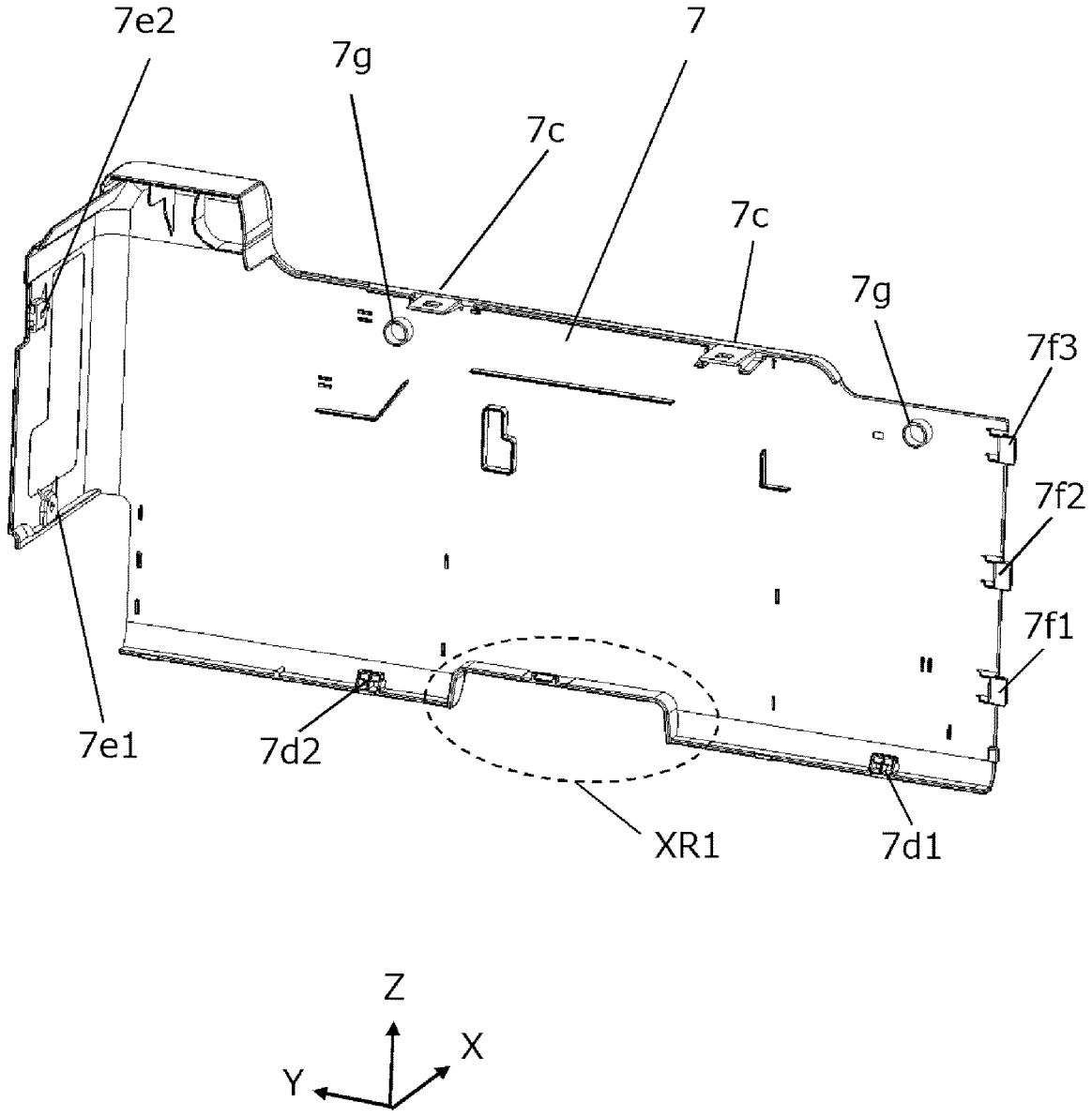
FIG. 13 is an oblique view of a right side cover according to the first embodiment.

FIG. 13 is an oblique view of the right side cover 7 in the recording apparatus 1 according to this embodiment. As illustrated in FIG. 13, the shape configuration on a side opposite to the side of an exterior surface of the right side cover 7 is similar to that of the left side cover 6 illustrated in FIG. 9. That is, the hook 7*c* is used to engage the right side cover 7 with a predetermined location of the upper case 9. The hooks 7*d*1 and 7*d*2 engage with the grooves 8*r*1 and 8*r*2 formed in the lower case 8. A counterbore shape 7*e*1 is used to screw the right side cover 7 to a predetermined location of the lower case 8. A counterbore shape 7*e*2 is used to screw the right side cover 7 to a predetermined location of the upper case 9. Hooks 7*f*1 to 7*f*3 are used to engage the right side cover 7 with a predetermined location of a right front cover 11. A boss 7*g* is a positioning boss for positioning by fitting the right side cover 7 on a predetermined location of the upper case 9.

Figure 14:
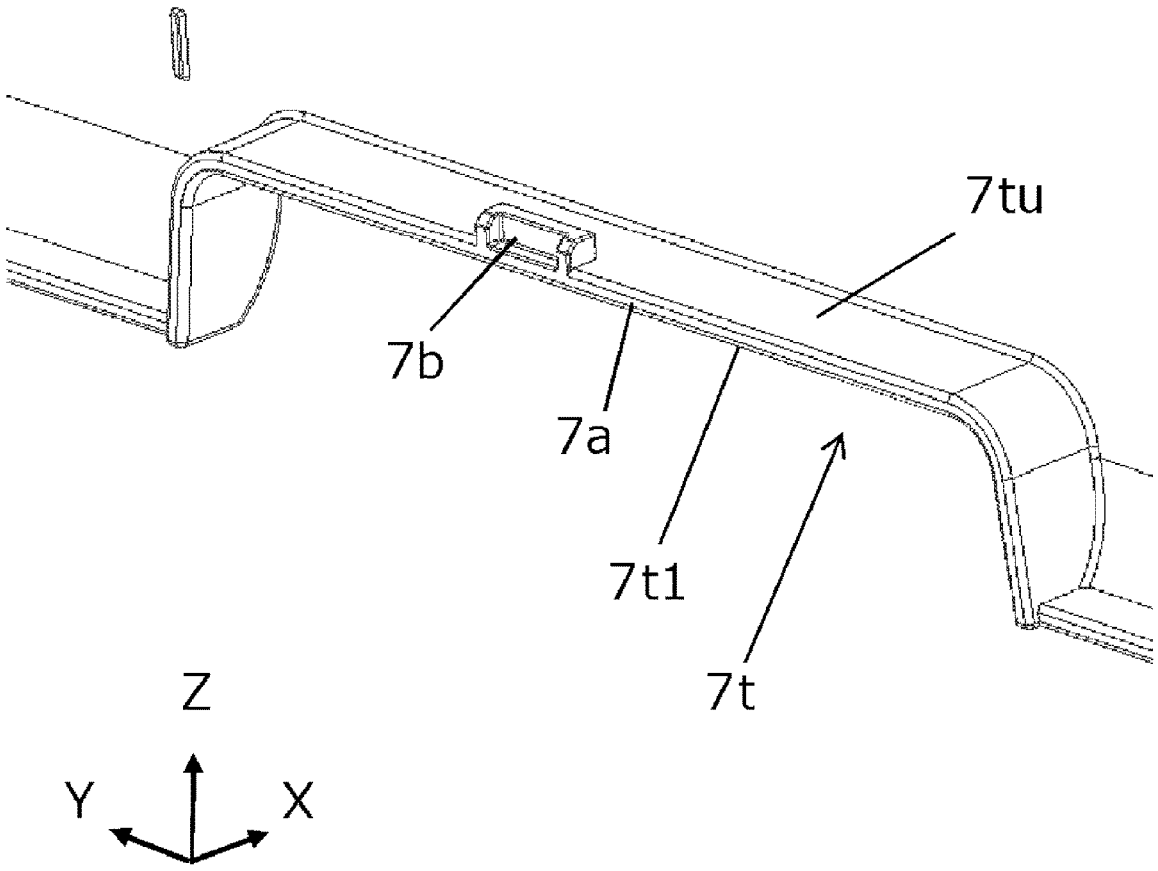
FIG. 14 is an enlarged view (right side cover) of an XR1 portion in FIG. 13.

FIG. 14 is an enlarged oblique view of an XR1 portion in FIG. 13. The holding portion 7*t* is provided at a position adjacent to the lower cover 8 at the lower end of the right side cover 7. The holding portion 7*t* is concave in an inverted U-shape upward from the lower end side of the right side cover 7, and has a shape that protrudes inward (X direction) from the back surface of the right side cover 7 to form a space at the lower end of the right side cover 7 that is concave from the outer wall surface of the right side cover 7 toward the inside of the apparatus. The concave space formed at the lower end of the right side cover 7 by the holding portion 7*t* is large enough for the operator or the like to insert his or her hand and grasp the holding portion 7*t*. The concave surface on the inner side of the holding portion 7*t* that forms such a space for grasping is a holding surface 7*t*1, and a convex outer side surface on the opposite side is an opposing surface 7*tu*, which is opposed to a constituent part serving as a boundary with the right side cover 7 in the lower case 8. In the vicinity of the holding portion 7*t*, a hook 7*b* is formed on the opposing surface 7*tu*, and an abutment surface 7*a* (contact portion) is formed at the tip of the holding portion 7*t*. It is possible to separate between the inside and the outside of the casing of the recording apparatus 1 and prevent leakage of mist to the outside of the recording apparatus 1 by causing the abutment surface 7*a* to abut against a vertical wall 8*a*2 of the lower case 8 described later.

Figure 15:
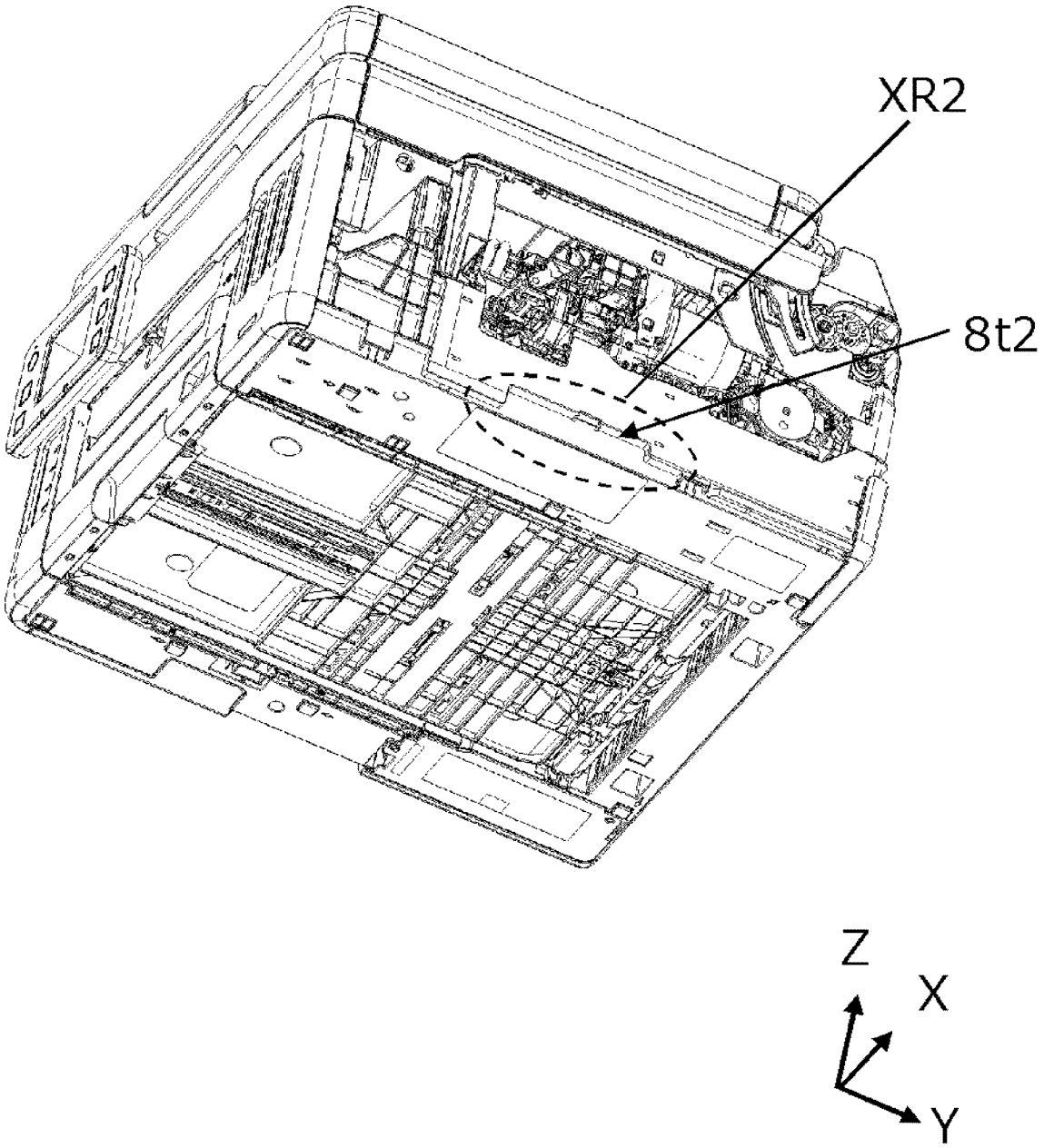
FIG. 15 is an oblique view of the right bottom of the recording apparatus according to the first embodiment.
Figure 16:
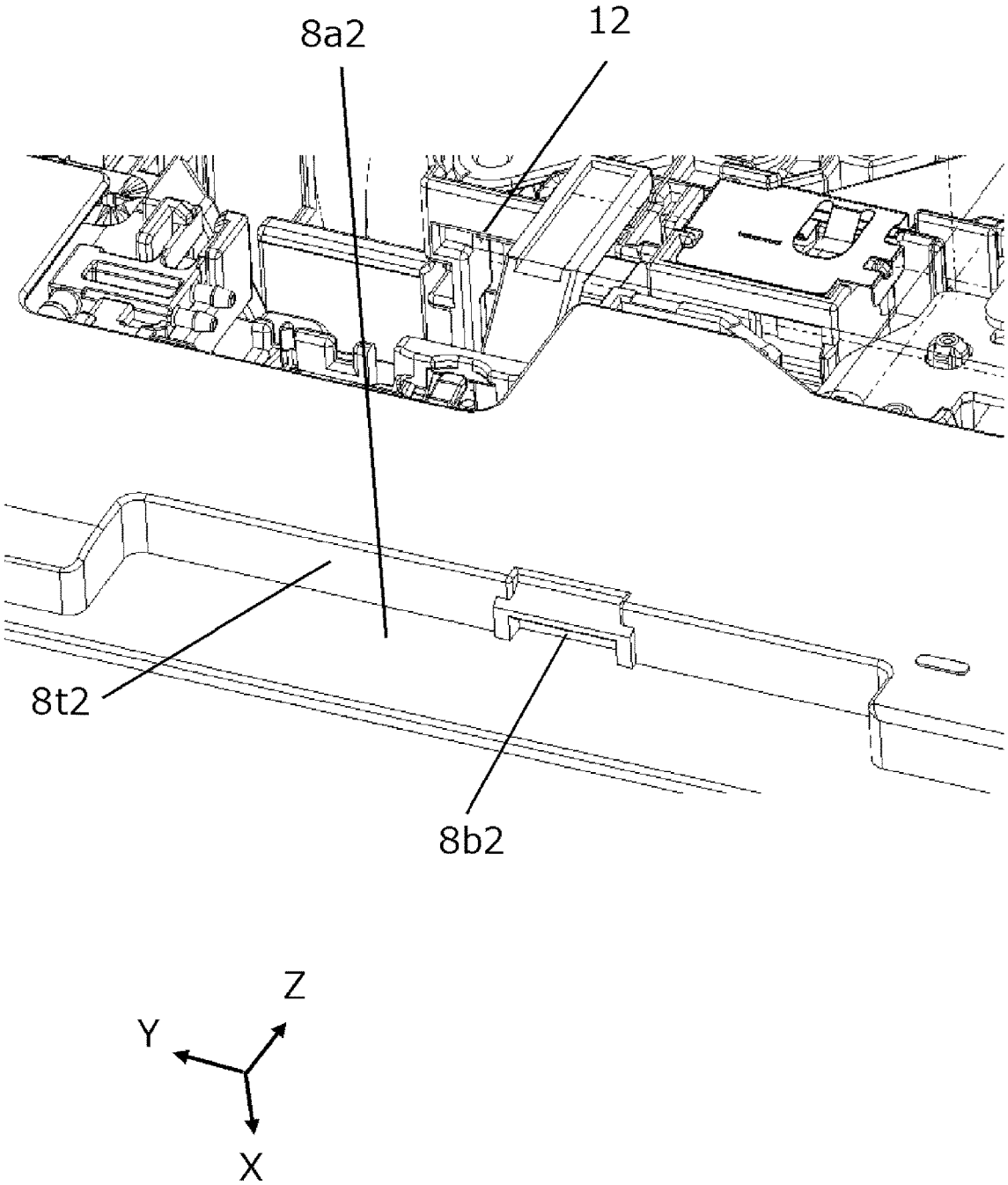
FIG. 16 is an enlarged view of an XR2 portion in FIG. 15.

FIG. 15 is an oblique view of the bottom of the recording apparatus 1 according to this embodiment (oblique view of looking up at the recording apparatus 1 from below at an angle that enables visual recognition of the front surface, the right side surface, and the bottom). FIG. 16 is an enlarged oblique view of an XR2 portion in FIG. 15. A horizontal portion 8*t*2 and the vertical wall 8*a*2 formed in the lower case 8 form a concave portion into which the holding portion 7*t* of the right side cover 7 is inserted. Furthermore, a groove 8*b*2 is formed on the lower surface of the horizontal portion 8*t*2. With the above-mentioned configuration, when the right side cover 7 is mounted to the main body 2, the hook 7*b* of the right side cover 7 engages with the groove 8*b*2 of the lower case 8. Furthermore, the abutment surface 7*a* of the right side cover 7 abuts against the vertical wall 8*a*2 formed in the lower case 8.

Figure 17:
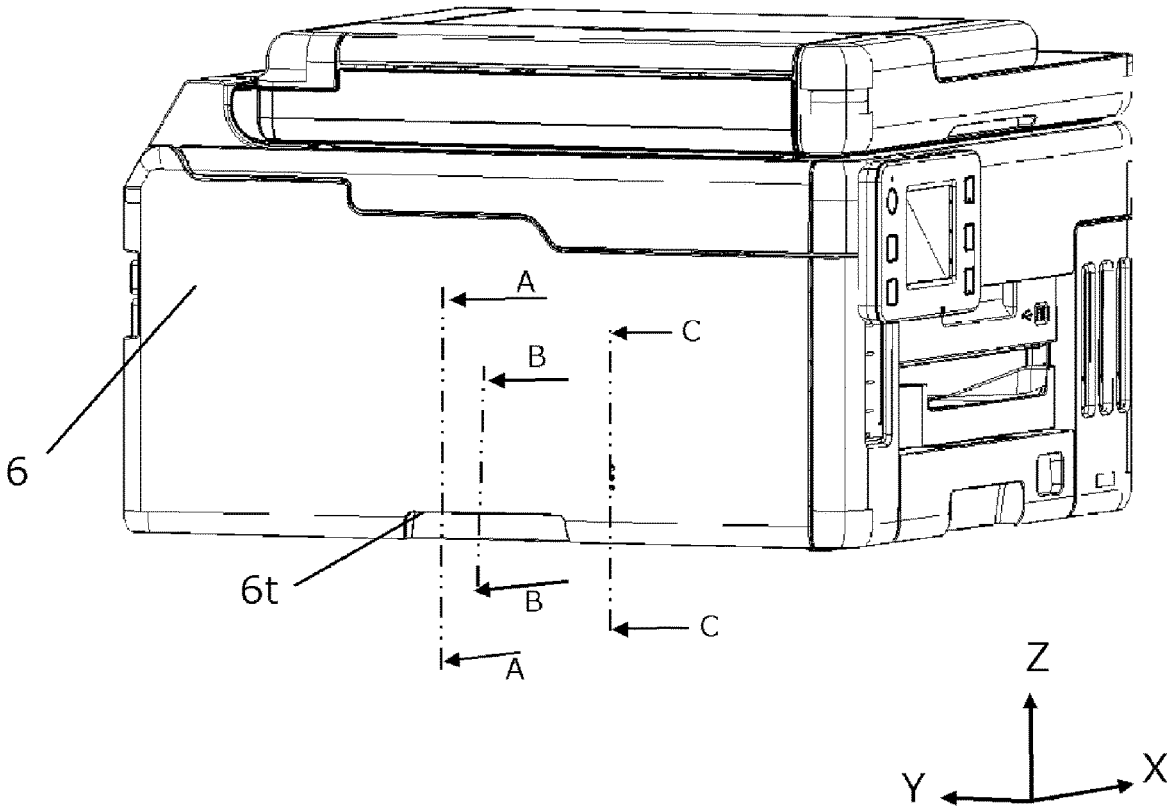
FIG. 17 is an oblique view of the left side of the recording apparatus according to the first embodiment.
Figure 18:
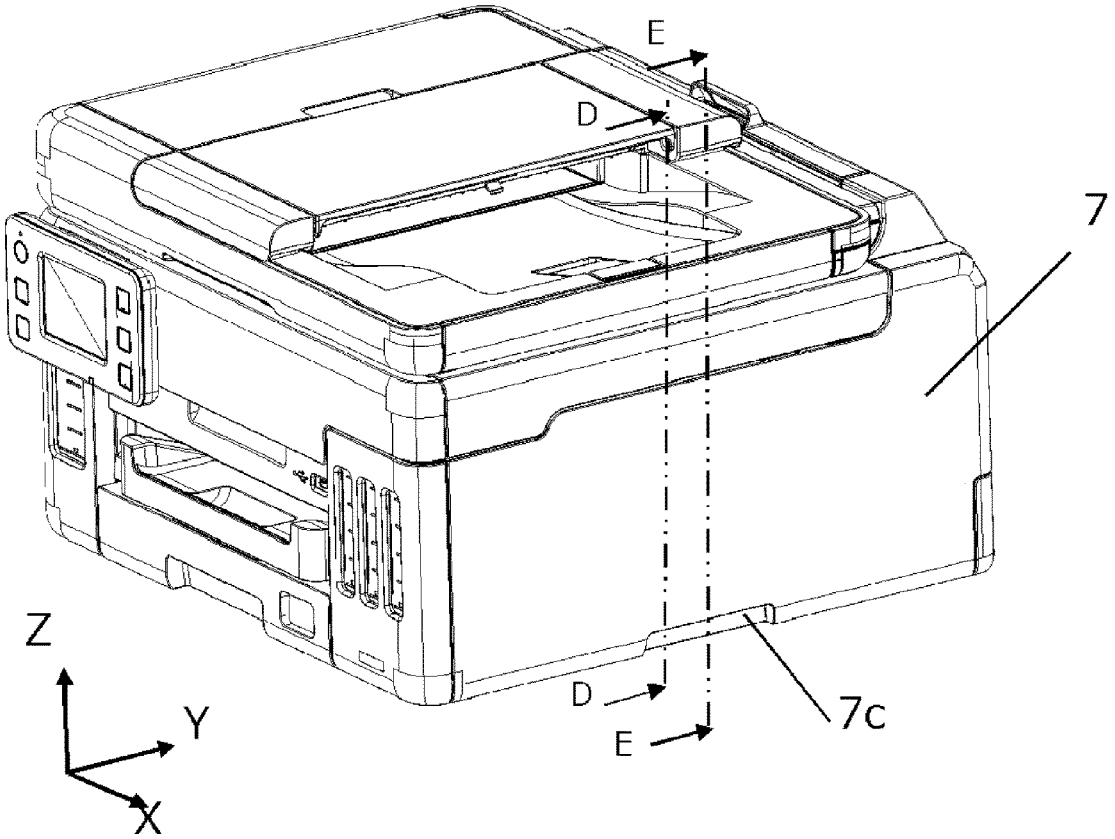
FIG. 18 is an oblique view of the right side of the recording apparatus according to the first embodiment.

Referring to FIGS. 17 to 21, 22A, 22B, 23, 24, 25A, and 25B, a mist leakage countermeasure configuration in the recording apparatus according to this embodiment is described. FIG. 17 is an oblique view of the left side surface of the recording apparatus 1 according to this embodiment, and FIG. 18 is an oblique view of the right side surface of the recording apparatus according to this embodiment.

Figure 19:
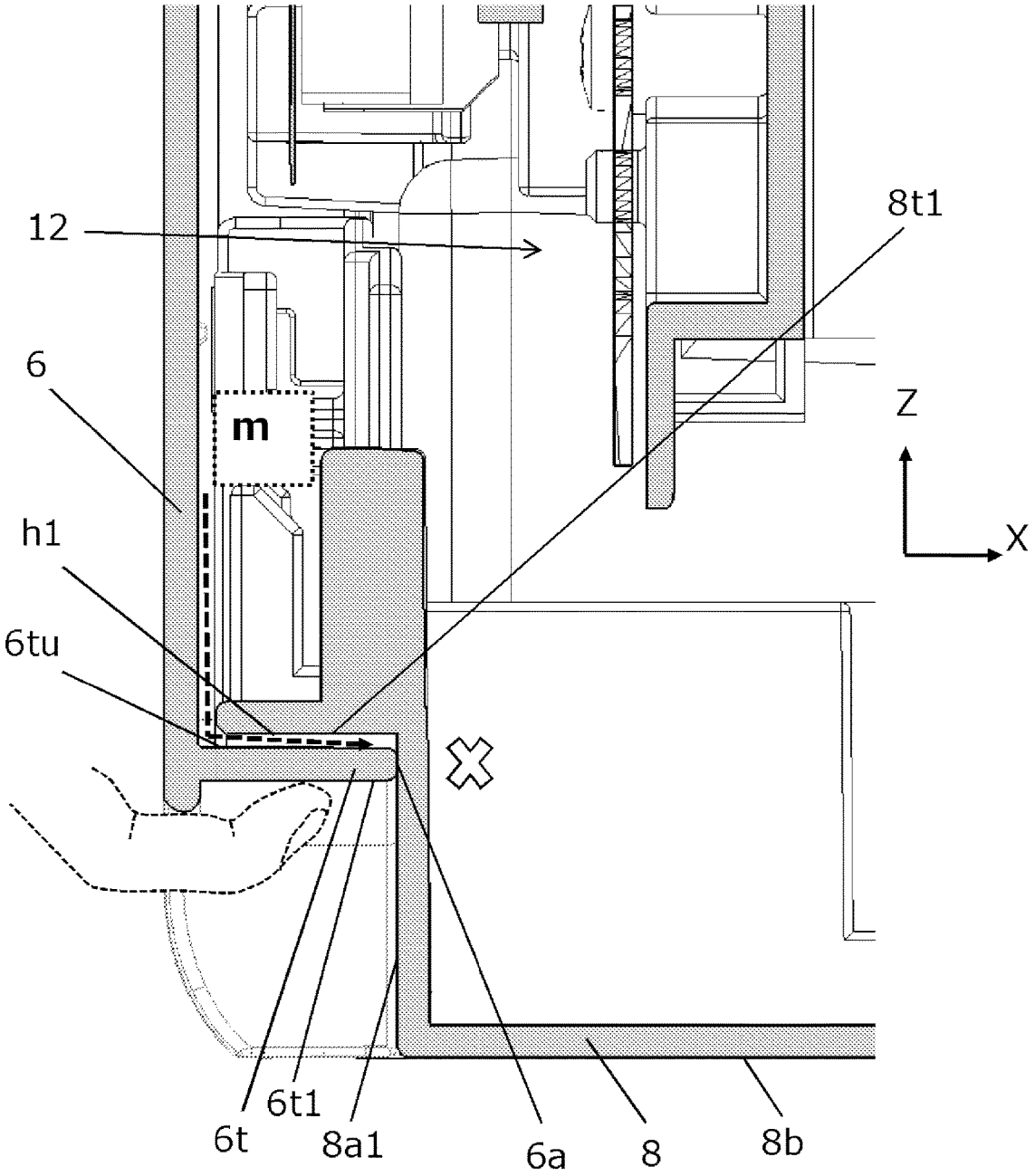
FIG. 19 is a cross-sectional view taken along a line A-A in FIG. 17.

FIG. 19 is a cross-sectional view taken along a line A-A in FIG. 17. As illustrated in FIG. 19, the vertical wall 8*a*1 formed in the lower case 8 and the holding portion 6*t* of the left side cover 6 form a space into which the finger (hand) of the user is inserted. The vertical wall 8*a*1 extends in a direction intersecting with a bottom surface of the recording apparatus (a bottom surface 8*b* of the lower case 8). As illustrated in FIG. 19, the vertical wall 8*a*1 extends in the direction intersecting with the bottom surface of the recording apparatus, which is parallel to a direction which the left side cover 6 extends (Z direction). The horizontal portion 8*t*1 extending from the upper end of the vertical wall 8*a*1 outward of the side of the apparatus is formed above the vertical wall 8*a*1. The abutment surface 6*a* of the holding portion 6*t* abuts against the vertical wall 8*a*1 to form a boundary wall surface that separates between the inside and the outside of the casing at the boundary between the lower case 8 and the left side cover 6. The horizontal portion 8*t*1 is connected to the boundary wall surface formed by the vertical wall 8*a*1, and forms, in the area facing the opposing surface 6*tu* of the holding portion 6*t*, an internal side wall surface extending in a direction orthogonal to the direction of extension of the side wall of the left side cover 6 toward the inside of the apparatus compared to the vertical wall 8*a*1. A gap h1 is formed between the horizontal portion 8*t*1 and the upper surface 6*tu* of the holding portion of the left side cover 6.

Mist m floating in the main body 2 tries to enter the gap h1. However, in the recording apparatus 1 according to this embodiment, the abutment surface 6*a* formed in the left side cover 6 abuts against the vertical wall 8*a*1 formed in the lower case 8 tightly, which restricts the mist m from moving beyond the contact surface. That is, leakage of the mist m from the main body 2 to the outside is restricted.

Figure 20:
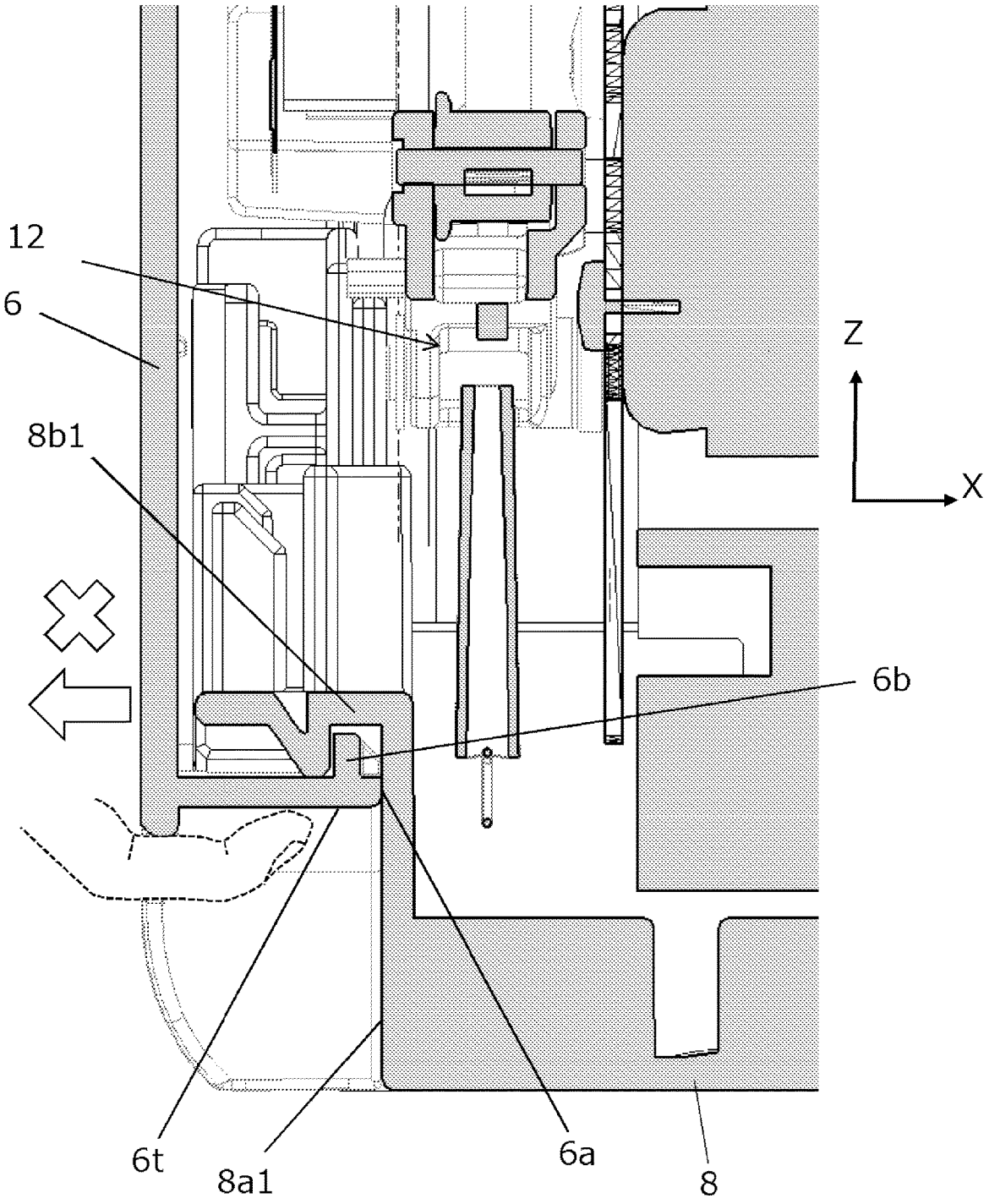
FIG. 20 is a cross-sectional view taken along a line B-B in FIG. 17.

FIG. 20 is a cross-sectional view taken along a line B-B in FIG. 17. The B-B cross section position is substantially an intermediate point in the depth (width) direction of the holding portion 6*t* in the left side cover 6. As illustrated in FIG. 20, the hook 6*b* (hook portion) formed in the left side cover 6 and the groove 8*b*1 (groove portion) formed in the lower case 8 engage with each other. Due to the design, a minute backlash occurs between the hook 6*b* and the groove 8*b*1. However, the grooves 8*l*1 and 8*l*2 formed in the lower case 8 described above and the hooks 6*d*1 and 6*d*2 of the side cover L6 engage with each other, respectively, so that abutment between the abutment surface 6*a* and the vertical wall 8*a*1 is restricted from separating. Therefore, it is possible to restrict leakage of mist.

Deformation or the like of the holding portion 6*t* is restricted also when the operator holds the holding portion 6*t* to lift up and move the recording apparatus 1 due to engagement between the hook 6*b* and the groove 8*b*1 (movement of the left side cover 6 in the arrow direction in FIG. 20 is regulated). That is, the groove 8*b*1 has a surface (groove side surface) opposed to the hook 6*b* in the same direction as the direction in which the abutment surface 6*a* abuts against the vertical wall 8*a*1, and is configured to be capable of engaging with the hook portion 6*b* when a force is applied to the holding portion 6*t* in the outward direction of the apparatus due to grasp by the operator. In this case, the surface engaging with the hook portion 6*b* in the groove 8*b*1 serves as a second boundary wall surface that separates between the inside and the outside of the casing at the boundary between the lower case 8 and the left side cover 6. That is, it is possible to restrict leakage of mist even in such a state.

Figure 21:
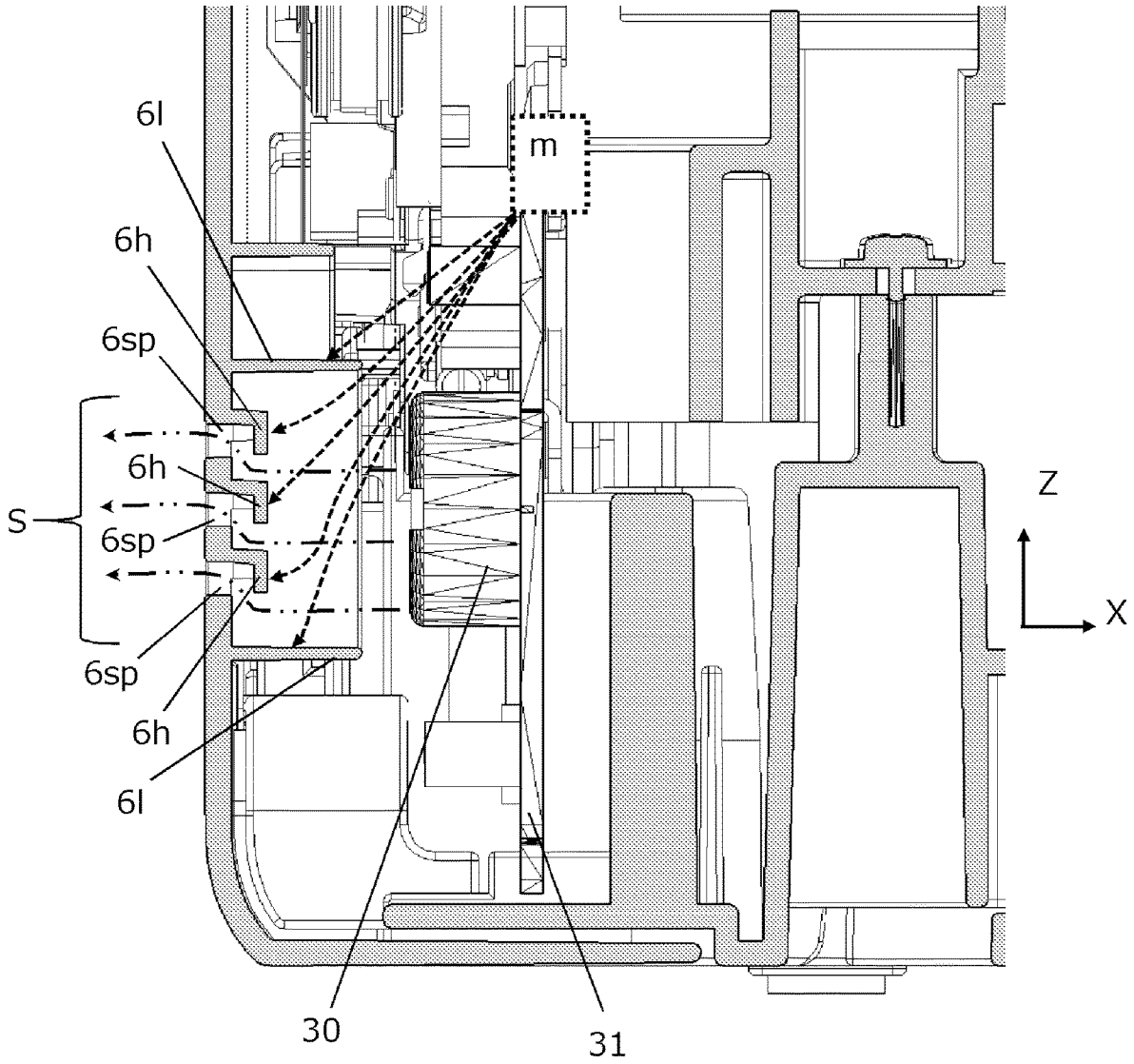
FIG. 21 is a cross-sectional view taken along a line C-C in FIG. 17.

FIG. 21 is a cross-sectional view taken along a line C-C in FIG. 17. In FIG. 21, a reference numeral 30 indicates a speaker that emits a notification sound for notifying the user or operator of an operation state of the apparatus, the end of the operation, or an abnormality of the apparatus. An electronic board 31 on which the speaker 30 is fixed and implemented is held at a predetermined location of the lower case 8. The speaker pores 6*sp* formed on the left side cover 6 are arranged at positions opposed to the speaker 30 on extension lines of the center of the speaker 30 in the vertical direction (arranged at a plurality of intervals in the Z direction at the positions of the center of the speaker 30 in the Y direction). Furthermore, the rib 6*l* formed in the left side cover 6 to collect a sound S emitted from the speaker 30 is placed substantially concentrically with the speaker 30. As illustrated in FIG. 21, a round rib 6*h*, which is concentric with the speaker pore 6*sp* and has a slightly smaller diameter than the diameter of the speaker pore 6*sp*, is placed at a position opposed to the apparatus inner opening of each of the speaker pores 6*sp* in the X direction. The round rib 6*h* is formed to extend downward in the Z direction from the tip of the semi-cylindrical support portion extending in the X direction from the inner opening edge of the speaker pore 6*sp*. With such a configuration, a shielding structure (shielding portion) that covers the front area of the inner opening of the speaker pore 6*sp* and an area excluding a lower area around the inner opening is formed in the area in which the speaker pore 6*sp* and the speaker 30 are opposed to each other. Thus, the sound S generated from the speaker 30 takes a path indicated by the double-dotted chain line as shown in FIG. 21, which reaches the speaker pore 6*sp* in a way that goes around from below the round rib 6*h*, and is released from the main body 2 to the outside. In this manner, the user or the operator can confirm various kinds of notification sounds emitted from the main body 2. However, the floating mist m, which has occurred inside the main body 2, is blocked by the rib 6*l* or the round rib 6*h* (dotted line), and is restricted from leaking from the speaker pore 6*sp* into the outside.

Figure 22A:
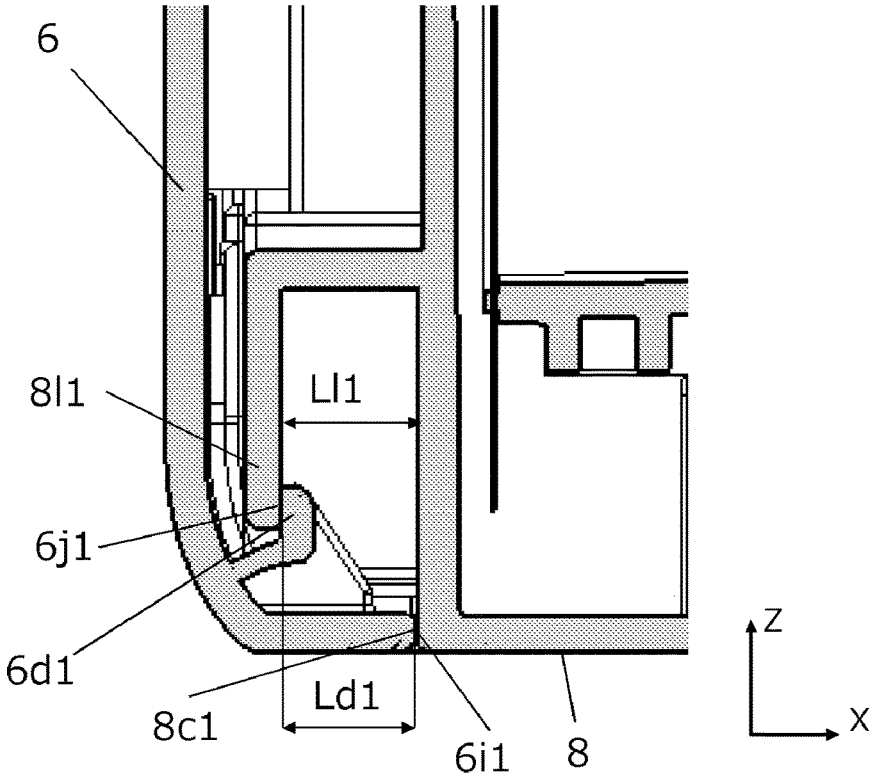
FIGS. 22A and 22B are cross-sectional views of an engagement portion between a lower case and the left side cover.
Figure 22B:
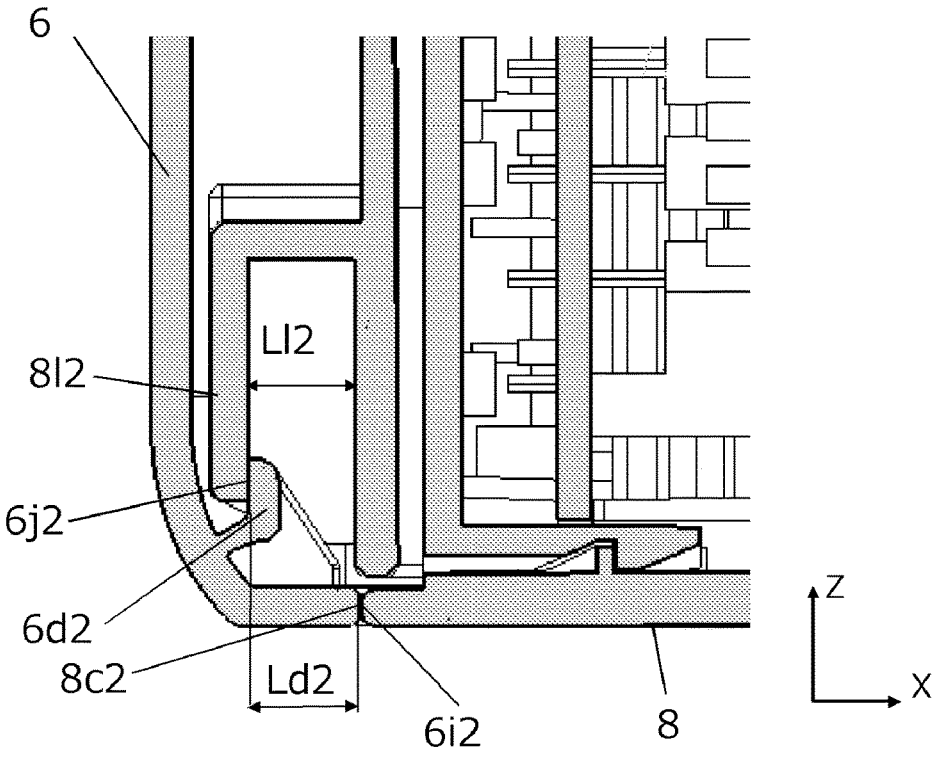

FIGS. 22A and 22B are cross-sectional views for describing the configuration of an engagement portion between the lower case 8 and the left side cover 6. FIG. 22A illustrates the situation of engagement between the groove 8*l*1 and the hook 6*d*1, and FIG. 22B illustrates the situation of engagement between the groove 8*l*2 and the hook 6*d*2.

As illustrated in FIG. 22A, the lower case 8 has the groove 8*l*1 as a locking portion for locking the left side cover 6. The left side cover 6 has a locked surface 6*j*1, which abuts against the groove side surface of the groove 8*l*1 in a direction opposite to the direction of the abutment surface 6*a* abutting against the vertical wall 8*a*1, and has a hook 6*d*1 serving as a locked portion that forms a state in which the left side cover 6 is locked to the lower case 8. The lower end of the left side cover 6 extends in a curved direction toward the inside of the apparatus, and a tip portion 6*i*1 abuts against a second vertical wall 8*c*1, which is provided in parallel to the vertical wall 8*a*1 of the lower case 8. In the width direction (X direction) of the apparatus, a distance Ld1 between the tip portion 6*i*1 and the locked surface 6*j*1 is set to be the same or slightly longer than the width Ll1 of the groove 8*l*1 (interval between the sides of the groove) in a natural state in which the hook 6*d*1 is not engaged with the groove 8*l*1. As a result, when the distance Ld1 is slightly longer than the width Ll1, the hook 6*d*1 is deformed and pressed into the groove 8*l*1 to engage with the groove 8*l*1, which causes a force of pressing the tip portion 6*i*1 against the vertical wall 8*c*1. In this manner, the tip portion 6*i*1 reliably abuts against the vertical wall 8*c*1.

The groove 8*l*2 and the hook 6*d*2 illustrated in FIG. 22B are configured similarly. Specifically, in the width direction (X direction) of the apparatus, a distance L*d*2 between the tip portion 6*i*2 and the locked surface 6*j*2 is set to be the same or slightly longer than the width Ll2 of the groove 8*l*2 (interval between the sides of the groove) in a natural state in which the hook 6*d*2 is not engaged with the groove 8*l*2. As a result, a force of pressing the tip portion 6*i*2 against a second vertical wall 8*c*2 provided in parallel to the vertical wall 8*a*1 of the lower case 8 is generated.

The engagement configuration as described above is provided to sandwich the holding portion 6*t* in the width direction (Y direction) of the lower end side of the left side cover 6, to thereby be able to achieve a configuration in which the abutment surface 6*a* of the holding portion 6*t* tightly abuts against the vertical wall 8*a*1 of the lower case 8. Such an engagement configuration may be provided in at least a pair across the holding portion 6*t*, but the number and combination of pairs to be provided are not limited to a one-to-one pair as in this embodiment.

Figure 23:
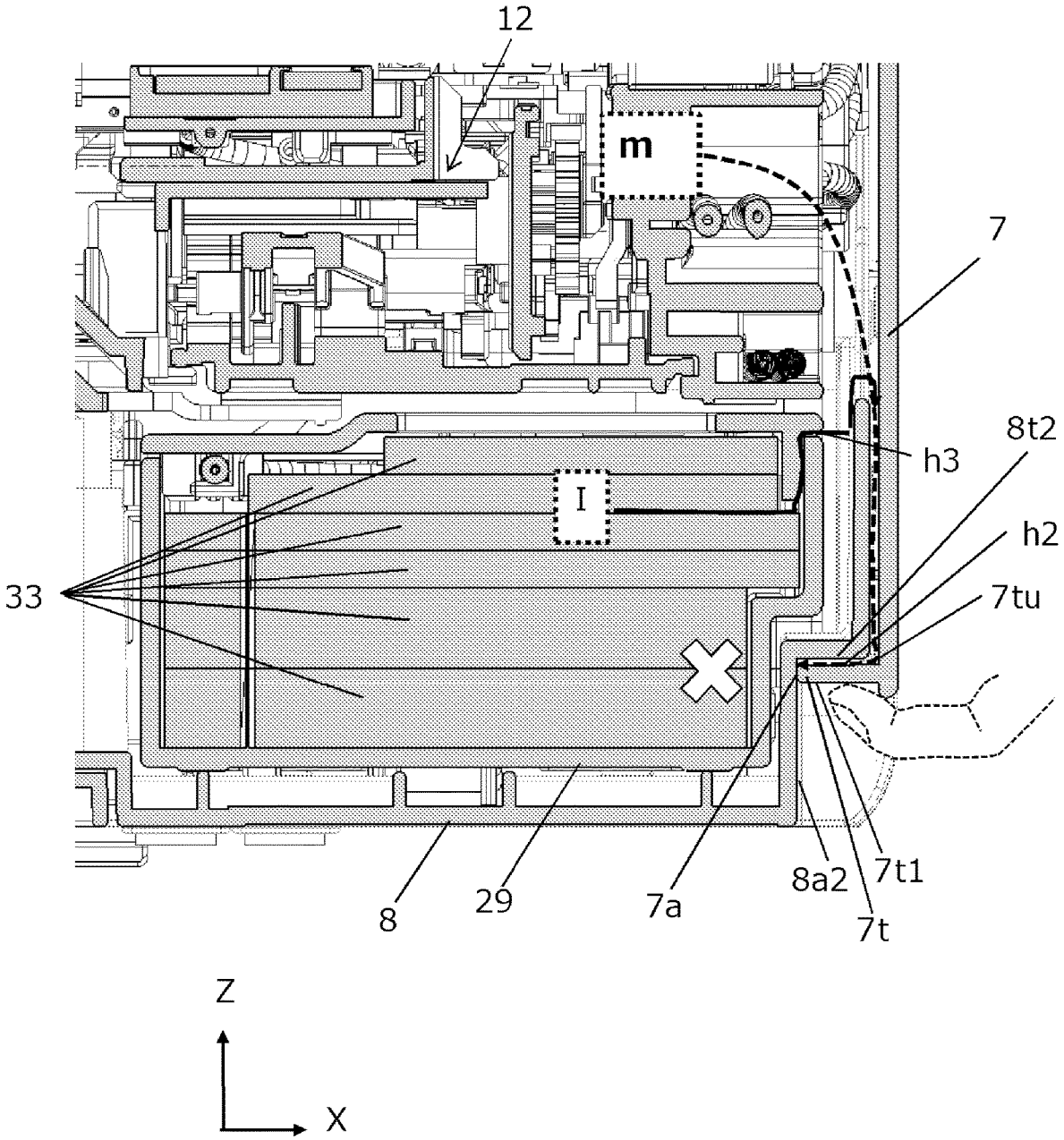
FIG. 23 is a cross-sectional view taken along a line D-D in FIG. 18.

FIG. 23 is a cross-sectional view taken along a line D-D in FIG. 18. With a configuration similar to that of the left side cover 6 described above, separation of abutment between the vertical wall 8*a*2 of the lower case 8 and the abutment surface 7*a* of the right side cover 7 is restricted, and thus it is possible to prevent leakage of mist therefrom.

In the maintenance cartridge 29, a plurality of absorbents 33 are arranged in the casing constructed by the upper/lower cases, and ink I discharged from the recording head 32 can be guided to the upper surface of the absorbent 33 and stored in the absorbent 33. However, as shown by the solid line in FIG. 23, ink I may move through the inner wall of the casing and leak from a gap h3 between the upper case and the lower case due to some factor, for example, a case in which the ink I guided to the maintenance cartridge 29 does not reach the absorbent 33 properly. There is a risk of ink leaking from the above gap h3 when the posture of the recording apparatus 1 has changed, for example, when the right surface of the recording apparatus 1 is turned downward especially under a state in which the ink I adheres and stays on the inner wall of the casing of the maintenance cartridge 29 due to distribution or the like.

In the case of the recording apparatus 1 according to this embodiment, even when ink has entered a gap h2 illustrated in FIG. 23, the abutment surface 7*a* of the right side cover 7 and the vertical wall 8*a*2 of the lower case 8 abut against each other, and thus the ink I does not leak from the outside of the main body 2. Therefore, the holding portion 7*t* and the table top are not stained with the ink I.

Figure 24:
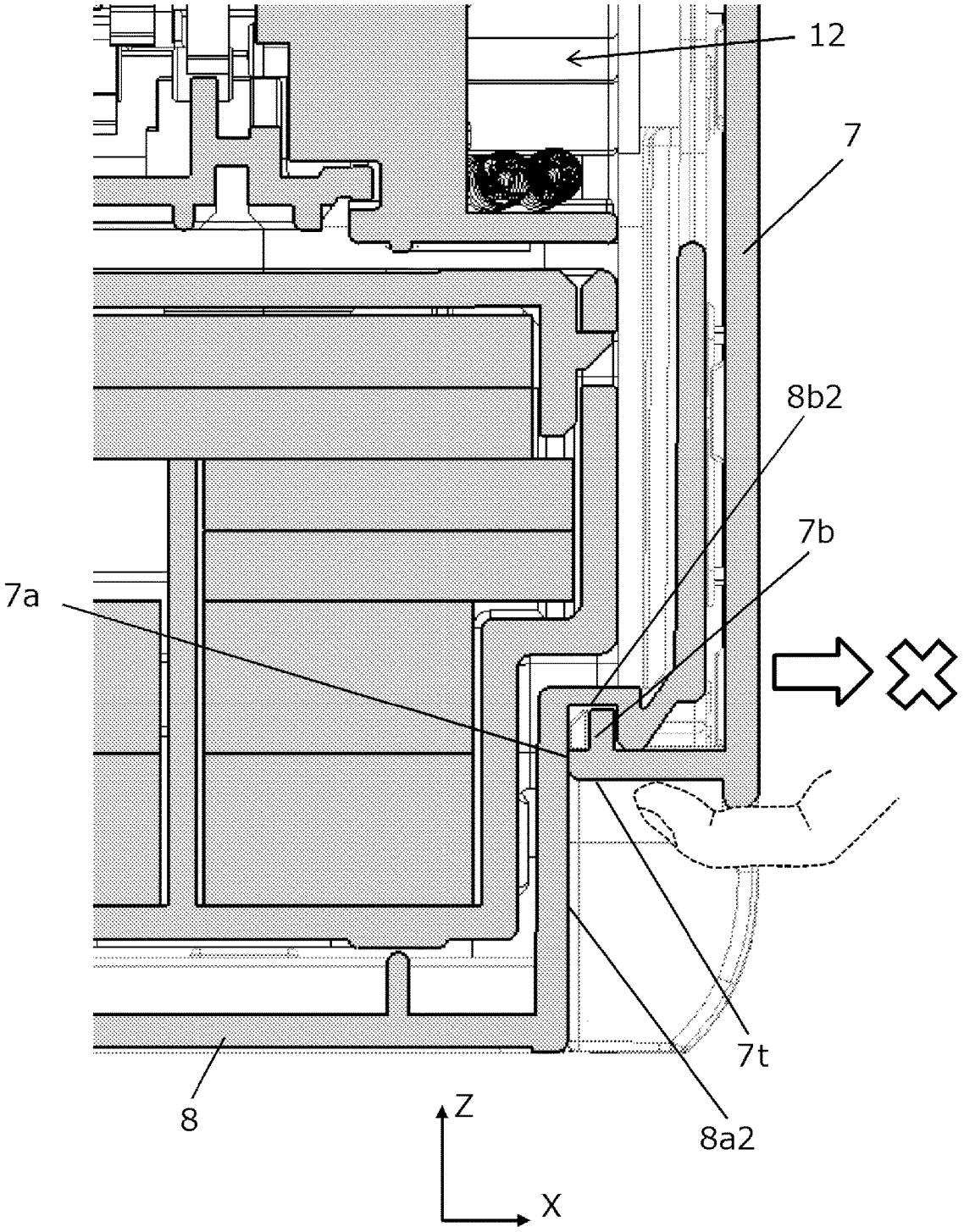
FIG. 24 is a cross-sectional view taken along a line E-E in FIG. 18.

FIG. 24 is a cross-sectional view taken along a line E-E in FIG. 18. As illustrated in FIG. 24, the hook 7*b* formed in the right side cover 7 and the groove 8*b*2 formed in the lower case 8 engage with each other. Due to the design, a minute backlash occurs between the hook 7*b* and the groove 8*b*2. However, the grooves 8*r*1 and 8*r*2 formed in the lower case 8 described above and the hooks 7*d*1 and 7*d*2 of the side cover R7 engage with each other, respectively, so that abutment between the abutment surface 7*a* and the vertical wall 8*a*2 is restricted from separating. Therefore, it is possible to restrict leakage of mist.

Deformation or the like of the holding portion 7*t* is restricted also when the operator holds the holding portion 7*t* to lift up and move the recording apparatus 1 due to engagement between the hook 7*b* and the groove 8*b*2 (movement of the right side cover 7 in the arrow direction in FIG. 24 is regulated). That is, the groove 8*b*2 has a surface (groove side surface) opposed to the hook 7*b* in the same direction as the direction in which the abutment surface 7*a* abuts against the vertical wall 8*a*2, and is configured to be capable of engaging with the hook portion 7*b* when a force is applied to the holding portion 7*t* in the outward direction of the apparatus due to grasp by the operator. In this case, the surface engaging with the hook portion 7*b* in the groove 8*b*2 serves as a second boundary wall surface that separates between the inside and the outside of the casing at the boundary between the lower case 8 and the right side cover 7. That is, it is possible to restrict leakage of mist even in such a state.

Figure 25A:
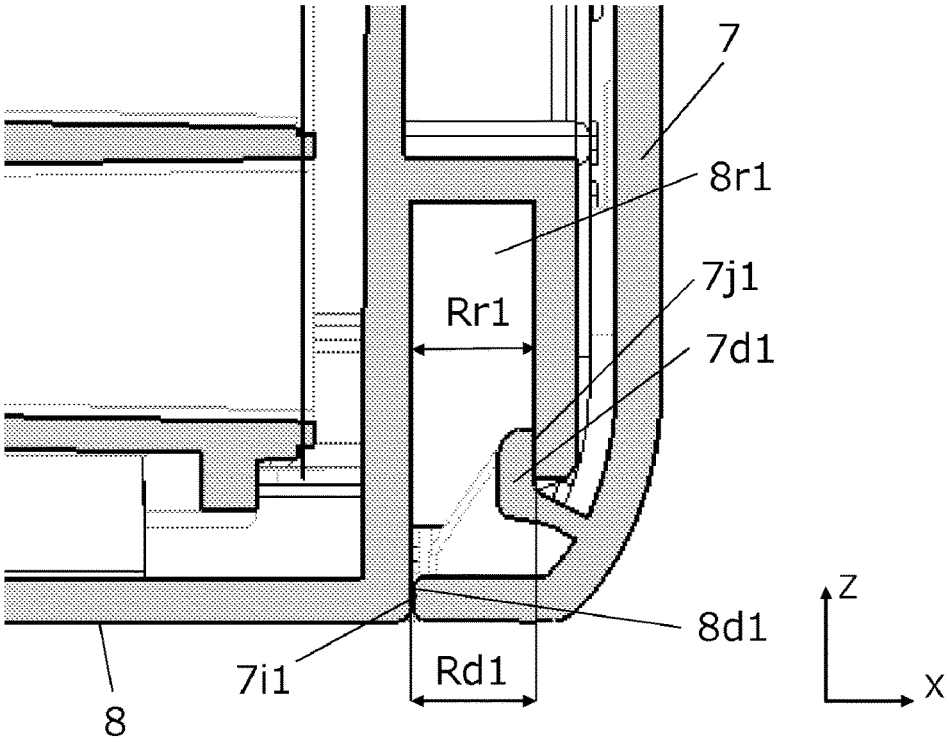
FIGS. 25A and 25B are cross-sectional views of an engagement portion between the lower case and the right side cover.
Figure 25B:
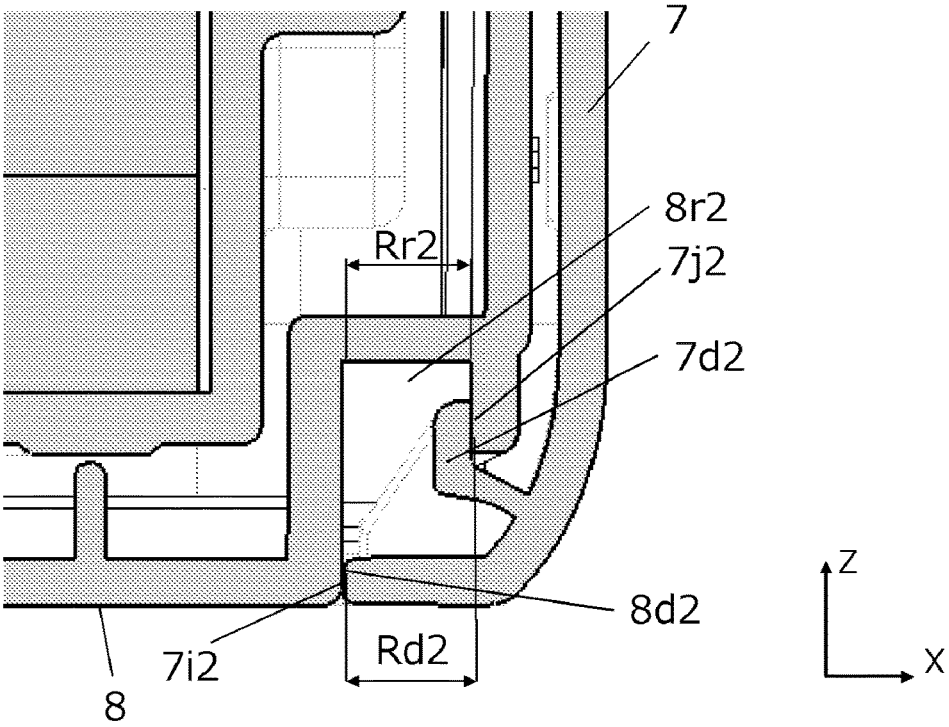

FIGS. 25A and 25B are cross-sectional views for describing the configuration of an engagement portion between the lower case 8 and the right side cover 7. FIG. 25A illustrates the situation of engagement between the groove 8*r*1 and the hook 7*d*1, and FIG. 22B illustrates the situation of engagement between the groove 8*r*2 and the hook 7*d*2.

As illustrated in FIG. 25A, the lower case 8 has the groove 8*r*1 as a locking portion for locking the right side cover 7. The right side cover 7 has a locked surface 7*j*1, which abuts against the groove side surface of the groove 8*r*1 in a direction opposite to the direction of the abutment surface 7*a* abutting against the vertical wall 8*a*2, and has a hook 7*d*1 serving as a locked portion that forms a state in which the right side cover 7 is locked to the lower case 8. The lower end of the right side cover 7 extends in a curved direction toward the inside of the apparatus, and a tip portion 7*i*1 abuts against a third vertical wall 8*d*1, which is provided in parallel to the vertical wall 8*a*1 of the lower case 8. In the width direction (X direction) of the apparatus, a distance R*d*1 between the tip portion 7*i*1 and the locked surface 7*j*1 is set to be the same or slightly longer than the width Rr1 of the groove 8*r*1 (interval between the sides of the groove) in a natural state in which the hook 7*d*1 is not engaged with the groove 8*r*1. As a result, when the distance R*d*1 is slightly longer than the width Rr1, the hook 7*d*1 is deformed and pressed into the groove 8*r*1 to engage with the groove 8*r*1, which causes a force of pressing the tip portion 7*i*1 against the vertical wall 8*d*1. In this manner, the tip portion 7*i*1 reliably abuts against the vertical wall 8*d*1.

The groove 8*r*2 and the hook 7*d*2 illustrated in FIG. 25B are configured similarly. Specifically, in the width direction (X direction) of the apparatus, a distance L*d*2 between the tip portion 7*i*2 and the locked surface 7*j*2 is set to be the same or slightly longer than the width Ll2 of the groove 8*l*2 (interval between the sides of the groove) in a natural state in which the hook 6*d*2 is not engaged with the groove 8*l*2. As a result, a force of pressing the tip portion 7*i*2 against a third vertical wall 8*d*2 provided in parallel to the vertical wall 8*a*1 of the lower case 8 is generated.

The engagement configuration as described above is provided to sandwich the holding portion 7*t* in the width direction (Y direction) of the lower end side of the right side cover 7, to thereby be able to achieve a configuration in which the abutment surface 7*a* of the holding portion 7*t* tightly abuts against the vertical wall 8*a*2 of the lower case 8. Such an engagement configuration may be provided in at least a pair across the holding portion 7*t*, but the number and combination of pairs to be provided are not limited to a one-to-one pair as in this embodiment.

With the above-mentioned configuration, leakage of the mist m floating inside the main body 2 from the holding portion 6*t* is restricted by causing the abutment surface 6*a* formed in the right side cover 7 and the vertical wall 8*a*1 formed in the lower case 8 to abut against each other. Therefore, the hand of the operator is restricted from being stained with mist, and the contact surface and working surface near the recording apparatus 1 are restricted from being stained.

Similarly, leakage of the mist m floating inside the main body 2 from the holding portion 7*t* is restricted by causing the abutment surface 7*a* formed in the right side cover 7 and the vertical wall 8*a*2 formed in the lower case 8 to abut against each other. Therefore, the hand (finger) of the operator or the like is restricted from being stained with the mist m, and the working surface near the recording apparatus 1 is restricted from being stained.

Second Embodiment

A recording apparatus according to a second embodiment of the present invention is described. In the second embodiment, the same configurations as those of the first embodiment are assigned with the same reference symbols as those of the first embodiment, and redundant description thereof is omitted. In the following, configurations that are not described particularly in the second embodiment are similar to those of the first embodiment.

Figure 26A:
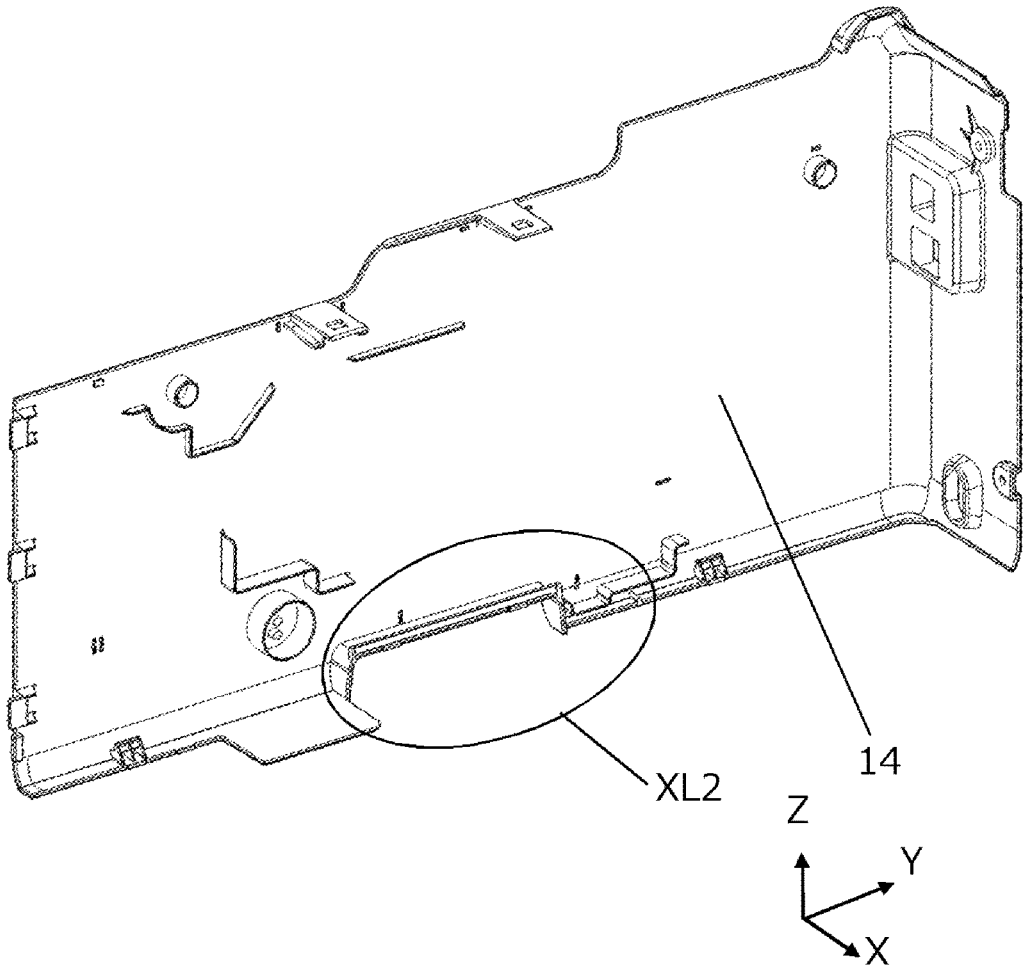
FIGS. 26A and 26B are oblique views of a left side cover in a second embodiment.
Figure 26B:
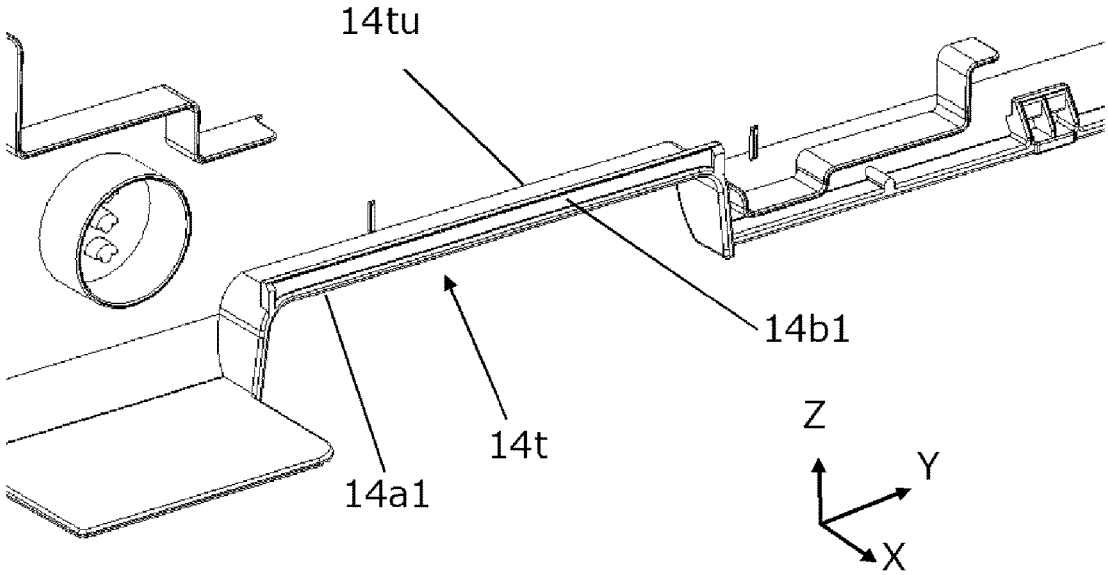

FIGS. 26A and 26B are oblique views of the left side cover 14 in the second embodiment. FIG. 26A is an oblique view of the inside of the left side cover 14, and FIG. 26B is an enlarged oblique view of the XL2 portion in FIG. 26A. As illustrated in FIG. 26B, a hook 14*b*1 is formed in the entire area of an opposing surface 14*tu* of a holding portion 14*t* of the left side cover 14.

Figure 27A:
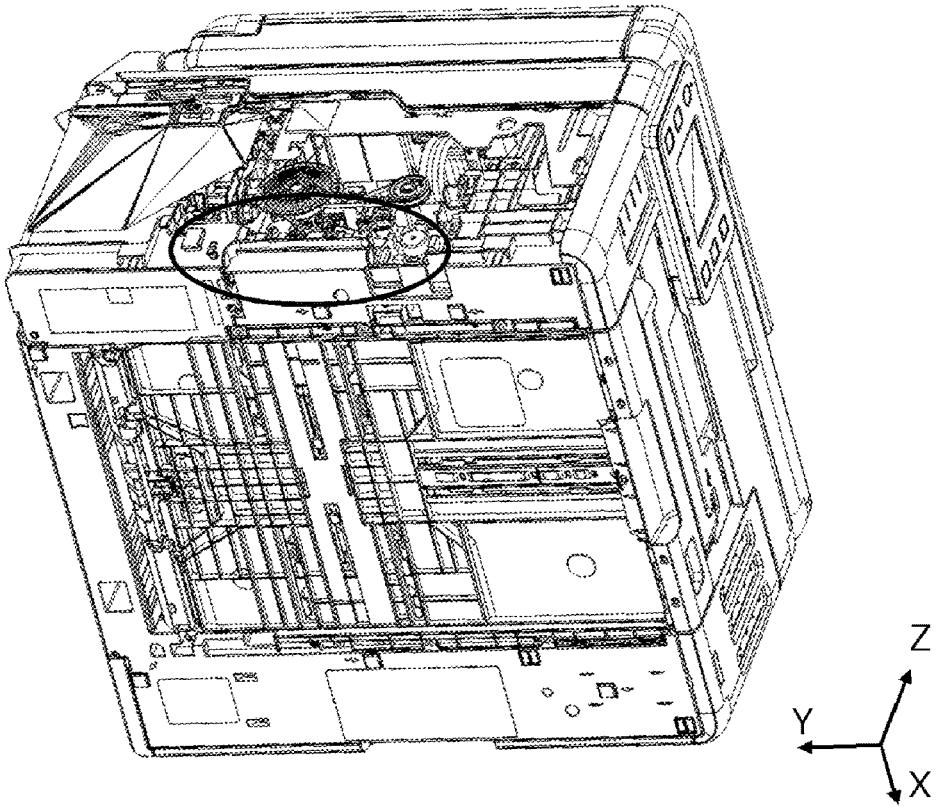
FIGS. 27A and 27B are oblique views of the left bottom of a lower case in the second embodiment.
Figure 27B:
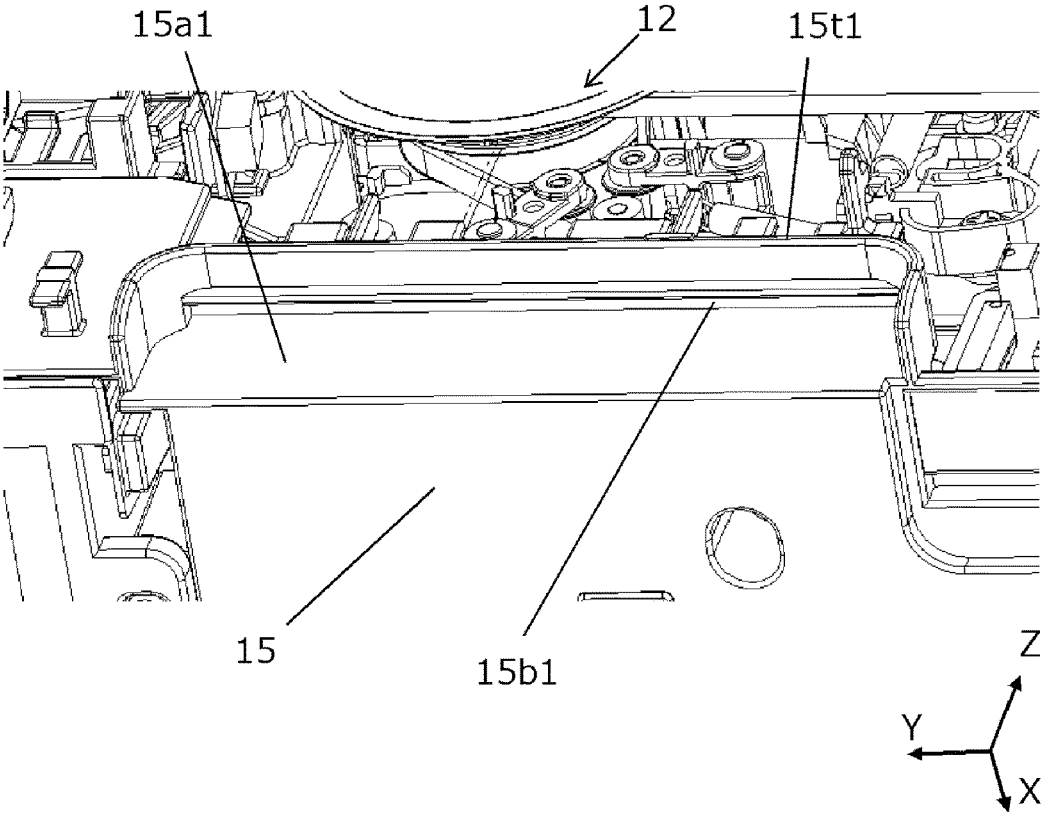

FIG. 27A is an oblique view of the left side surface of the recording apparatus 1 according to the second embodiment, which is an oblique view in a state in which the left side cover 14 is removed (oblique view of looking up at the recording apparatus 1 from below at an angle that enables visual recognition of the front surface, the left side surface, and the bottom). FIG. 27B is an enlarged view of the concave portion of the lower case 15 into which the holding portion 14*t* of the left side cover 14 is inserted. As illustrated in FIG. 27B, a groove 15*b*1 is formed in a horizontal portion 15*t*1 of the lower case 15 over the entire area in the apparatus depth direction (Y direction).

The groove 15*b*1 has a groove side surface 15*c* as an inward facing surface facing in a direction (toward the inside of the apparatus in the X direction) opposite to a direction (toward the outside of the apparatus in the X direction) in which the outer wall surface of the left side cover 14 faces. In this embodiment, the groove side surface 15*c* serves as a boundary wall surface that separates between the inside and the outside of the casing at the boundary between the lower case 8 and the left side cover 14.

Figure 28:
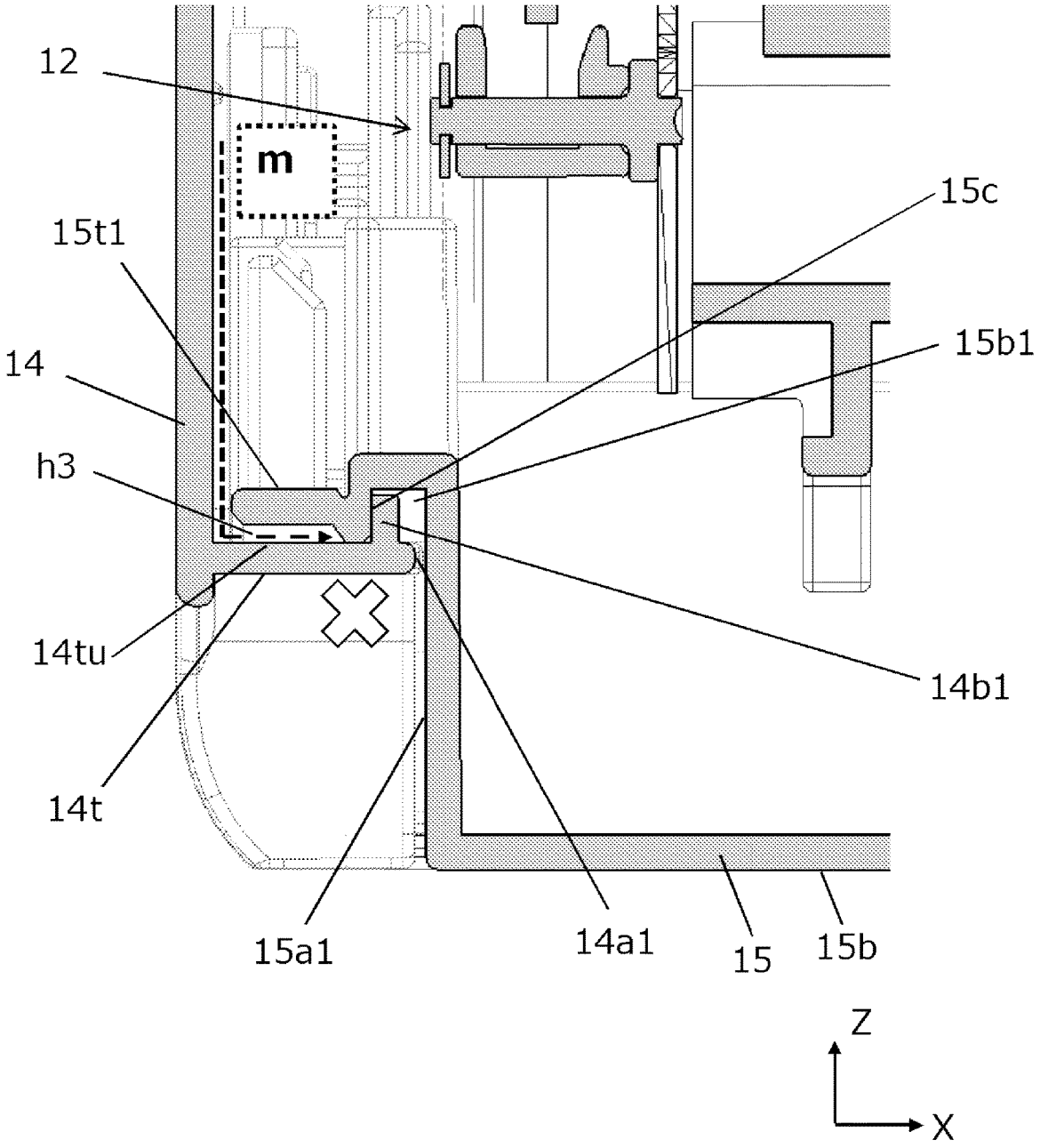
FIG. 28 is a cross-sectional view of a contact portion through which the left side cover and the lower case abut against each other in the second embodiment.

FIG. 28 is a schematic cross-sectional view of the left side cover 14 and the holding portion of the lower case 15 in the second embodiment. The mist m floating in the main body tries to move toward the holding portion through the gap h3 (gap between the opposing surface 14*tu* and the horizontal portion 15*t*1). However, the contact portion between the hook 14*b*1 of the left side cover 14 and the groove 15*b*1 (groove side surface 15*c*) of the lower case 15 restricts the mist m from moving further. In other words, leakage of mist from the holding portion 14*t* to the outside is restricted. Furthermore, the above-mentioned contact portion is provided over the entire area of the range to be held by the hand (finger) of the operator or the like, and thus the risk of the hand of the operator being stained with the mist m is reduced.

In the second embodiment, the surface 14*a*1 of the left side cover 14 and the vertical wall 15*a*1 of the lower case are not caused to abut against each other to ensure a minute backlash at the time of assembling. However, with the above-mentioned means, that is, movement of the mist m is restricted by the contact surface (abutment surface) between the hook 14*b*1 and the lower case 15*b*1, and thus leakage of the mist m from the main body 2 to the outside is restricted.

The configuration of the right side cover (not shown) in the second embodiment is similar to the above-mentioned left side cover 14, and thus description thereof is omitted here.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-023532, filed on Feb. 17, 2021, which is hereby incorporated by reference herein in its entirety.

What is claimed is:

1. A recording apparatus, comprising:

a recording portion that records an image on a recording material by ejecting liquid to the recording material;

a case that forms a bottom of a casing in which the recording portion is accommodated;

a cover that forms a side wall of the casing, which has a holding portion to be grasped at a time of carrying the recording apparatus at a position adjacent to the case; and a speaker that emits a notification sound, which is accommodated in the casing, wherein the case has a boundary wall surface extending in a direction intersecting with a bottom surface of the recording apparatus toward an inside of the casing, wherein the cover has a contact portion that abuts against the boundary wall surface of the case in a vicinity of the holding portion, wherein the contact portion and the boundary wall surface are arranged in line in a direction that intersects with a direction in which the side wall is formed, and the contact portion and the boundary wall surface abut against each other to separate between an inside and an outside of the casing, wherein the cover has a speaker pore at a position opposed to the speaker, and wherein the cover has a shielding portion that covers a front area of an inner opening of the casing in the speaker pore and an area excluding a lower area around the inner opening in an area in which the speaker and the speaker pore are opposed to each other.

2. The recording apparatus according to claim 1, wherein the case has a locking portion for locking the cover, and wherein the cover has a locked portion that forms a state in which the cover is locked to the case by abutting against the locking portion in a direction opposite to a direction in which the contact portion abuts against the boundary wall surface.

3. The recording apparatus according to claim 2, wherein the holding portion is provided at a lower end of the side wall, and wherein the locking portion and the locked portion are arranged in at least a pair across the holding portion in a width direction of a lower end side of the side wall.

4. The recording apparatus according to claim 1, wherein the holding portion has a holding surface to be touched by a user at the time of carrying the recording apparatus, the holding surface extending from a lower end of the side wall toward the boundary wall surface in a direction that intersects with a direction of extension of the side wall, and wherein the contact portion is provided at a tip of a direction of extension of the holding surface in the holding portion.

5. The recording apparatus according to claim 4, wherein the case has an internal side wall surface extending in a direction that intersects with a direction of extension of the side wall toward an internal side of the casing in a region opposed to a surface on a side opposite to a side of the holding surface of the holding portion on an internal side of the recording apparatus compared to the boundary wall surface.

6. The recording apparatus according to claim 1, wherein the case has a groove portion on an internal side of the recording apparatus compared to the boundary wall surface, wherein the cover has a hook portion capable of engaging with the groove portion in a vicinity of the holding portion, and wherein the groove portion has a surface opposed to the hook portion in the same direction as a direction in which the contact portion abuts against the boundary wall surface.

7. The recording apparatus according to claim 1, wherein the case has a groove portion in an area opposed to the holding portion, wherein the cover has a hook portion capable of engaging with the groove portion in a vicinity of the holding portion, wherein the groove portion has an inward facing surface facing in a direction opposite to a direction in which an outer wall surface of the side wall faces, and wherein the hook portion serving as the contact portion and the inward facing surface serving as the boundary wall surface abut against each other in a direction orthogonal to a direction of extension of the side wall.

8. The recording apparatus according to claim 7, wherein the groove portion and the hook portion extend over an entire area of a width of the holding portion along a lower end side of the outer wall surface.

9. The recording apparatus according to claim 1, wherein the holding portion forms a concave portion that is partially concave inward of an outer wall surface of the side wall substantially at a center of a lower end side of the outer wall surface in a width direction.

* * * * *